US008469471B2

(12) United States Patent
Kikuchi et al.

(10) Patent No.: US 8,469,471 B2
(45) Date of Patent: Jun. 25, 2013

(54) IMAGE FORMING APPARATUS

(75) Inventors: Naoki Kikuchi, Kanagawa (JP); Masanori Hirano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 598 days.

(21) Appl. No.: 12/440,858

(22) PCT Filed: Jun. 27, 2008

(86) PCT No.: PCT/JP2008/062126

§ 371 (c)(1),
(2), (4) Date: Mar. 11, 2009

(87) PCT Pub. No.: WO2009/008339

PCT Pub. Date: Jan. 15, 2009

(65) Prior Publication Data

US 2010/0002039 A1 Jan. 7, 2010

(30) Foreign Application Priority Data

Jul. 11, 2007 (JP) ..... 2007-182626

(51) Int. Cl.
*B41J 29/38* (2006.01)

(52) U.S. Cl.
USPC ..... 347/5; 347/2; 347/14

(58) Field of Classification Search
USPC ..... 347/5, 55, 19, 2, 9, 14
See application file for complete search history.

(56) References Cited

U.S. PATENT DOCUMENTS 5,130,726 A 7/1992 Fukushima et al.
5,138,178 A 8/1992 Wong et al.
6,158,837 A * 12/2000 Hilton et al. ..... 347/19
6,382,771 B1 * 5/2002 Ikeda et al. ..... 347/55
7,083,247 B2 8/2006 Yoshida et al.
7,393,078 B2 * 7/2008 Yazawa et al. ..... 347/19
7,588,300 B2 * 9/2009 Koga et al. ..... 347/5
2002/0054183 A1 5/2002 Kanaya
2003/0016259 A1 * 1/2003 Otokita ..... 347/14
2004/0213610 A1 10/2004 Yuasa (Continued)

FOREIGN PATENT DOCUMENTS

EP 1 470 925 A1 10/2004
JP 2 245356 10/1990

(Continued)

OTHER PUBLICATIONS

Office Action issued Aug. 21, 2012 in Japanese Patent Application No. 2007-182626.

(Continued)

*Primary Examiner* — Lam S Nguyen

(74) *Attorney, Agent, or Firm* — Oblon, Spivak, McClelland, Maier & Neustadt, L.L.P.

(57) ABSTRACT

An image forming apparatus enables the output of a high-quality image even when an expendable supply, such as ink, recording head, or recording sheet other than a specific expendable supply, such as one designated by a manufacturer, is used. The image forming apparatus includes a carriage for moving a recording head having plural recording nozzles in a horizontal scan direction. The recording head discharges ink onto a recording medium. A detection unit detects whether one or more expendable supplies required for image formation is a specific expendable supply. Upon detection of a non-specific expendable supply, a notifying unit notifies an operator and suggests that the image forming method be changed.

10 Claims, 25 Drawing Sheets

| INK | RECORDING HEAD | RECORDING MEDIUM | PRINT CLOCK | CARRIAGE SPEED | NO. OF PASSES | PRINT DIRECTION | ... |
|---|---|---|---|---|---|---|---|
| SPECIFIC ITEM | SPECIFIC ITEM | SPECIFIC ITEM | 24 | 12 | 1 | BOTH | |
| | | NON-SPECIFIC ITEM | 12 | 12 | 1 | BOTH | |
| | NON-SPECIFIC ITEM | SPECIFIC ITEM | 12 | 12 | 2 | BOTH | |
| | | NON-SPECIFIC ITEM | 12 | 6 | 2 | BOTH | |
| NON-SPECIFIC ITEM | SPECIFIC ITEM | SPECIFIC ITEM | 12 | 6 | 1 | BOTH | |
| | | NON-SPECIFIC ITEM | 12 | 6 | 2 | BOTH | |
| | NON-SPECIFIC ITEM | SPECIFIC ITEM | 6 | 6 | 2 | ONE | |
| | | NON-SPECIFIC ITEM | 3 | 6 | 4 | ONE | |

U.S. PATENT DOCUMENTS

| | | | |
|---|---|---|---|
| 2005/0078165 | A1 | 4/2005 | Harada et al. |
| 2005/0200900 | A1 | 9/2005 | Hirano |
| 2006/0092206 | A1 | 5/2006 | Kimura et al. |
| 2006/0098232 | A1 | 5/2006 | Nakano et al. |
| 2006/0181562 | A1 | 8/2006 | Hirano et al. |
| 2006/0210284 | A1 | 9/2006 | Mine et al. |

FOREIGN PATENT DOCUMENTS

| | | | |
|---|---|---|---|
| JP | 4-500482 | A | 1/1992 |
| JP | 6 134982 | | 5/1994 |
| JP | 11 157059 | | 6/1999 |
| JP | 11 227178 | | 8/1999 |
| JP | 2000 190481 | | 7/2000 |
| JP | 3095008 | | 10/2000 |
| JP | 2000 326518 | | 11/2000 |
| JP | 2001 75455 | | 3/2001 |
| JP | 2001 334686 | | 12/2001 |
| JP | 2002 137382 | | 5/2002 |
| JP | 2002 149019 | | 5/2002 |
| JP | 2002 264323 | | 9/2002 |
| JP | 2002 331686 | | 11/2002 |
| JP | 2003 154734 | | 5/2003 |
| JP | 2003-300316 | A | 10/2003 |
| JP | 2003-326741 | A | 11/2003 |
| JP | 2004 188635 | | 7/2004 |
| JP | 2004-330645 | A | 11/2004 |
| JP | 2005 115054 | | 4/2005 |
| JP | 2005-169749 | A | 6/2005 |
| JP | 2005 186378 | | 7/2005 |
| JP | 2005 193522 | | 7/2005 |
| JP | 2005 199696 | | 7/2005 |
| JP | 2005 288845 | | 10/2005 |
| JP | 2006 187989 | | 7/2006 |
| JP | 2006 187991 | | 7/2006 |
| JP | 2006 276709 | | 10/2006 |
| JP | 2007 24837 | | 2/2007 |
| JP | 2007 98879 | | 4/2007 |

OTHER PUBLICATIONS

Extended European Search Report issued on Jan. 28, 2011, in EP 08 77 7864.

* cited by examiner

PRINT CLOCK=24KHZ

MAIN SCAN
CARRIAGE SPEED=12KHZ

PRINT CLOCK=24KHZ

MAIN SCAN
CARRIAGE SPEED=12KHZ

PRINT CLOCK=12KHZ

MAIN SCAN
CARRIAGE SPEED=6KHZ

PRINT CLOCK=12KHZ

MAIN SCAN
CARRIAGE SPEED=6KHZ

FIG.31

| INK | RECORDING HEAD | RECORDING MEDIUM | PRINT CLOCK | CARRIAGE SPEED | NO. OF PASSES | PRINT DIRECTION | ... |
|---|---|---|---|---|---|---|---|
| SPECIFIC ITEM | SPECIFIC ITEM | SPECIFIC ITEM | 24 | 12 | 1 | BOTH | |
| | | NON-SPECIFIC ITEM | 12 | 12 | 1 | BOTH | |
| | NON-SPECIFIC ITEM | SPECIFIC ITEM | 12 | 12 | 2 | BOTH | |
| | | NON-SPECIFIC ITEM | 12 | 6 | 2 | BOTH | |
| NON-SPECIFIC ITEM | SPECIFIC ITEM | SPECIFIC ITEM | 12 | 6 | 1 | BOTH | |
| | | NON-SPECIFIC ITEM | 12 | 6 | 2 | BOTH | |
| | NON-SPECIFIC ITEM | SPECIFIC ITEM | 6 | 6 | 2 | ONE | |
| | | NON-SPECIFIC ITEM | 3 | 6 | 4 | ONE | |

IMAGE FORMING APPARATUS

TECHNICAL FIELD

The present invention relates to image forming apparatuses, and particularly to an image forming apparatus capable of providing stable image quality when an expendable supply, such as ink, an inkjet head, or a recording medium, that is not a specific expendable supply is used.

BACKGROUND ART

In an inkjet recording apparatus, which is an example of image forming apparatuses including printers, facsimile machines, and copy machines, a liquid discharge head is used as a recording head. The liquid discharge head discharges ink as a recording liquid onto a sheet to form (i.e., record, print, or transcribe) an image. The "sheet" herein is not limited to a sheet of paper but it includes any medium onto which a droplet of ink or other liquid can attach. Thus, the sheet may also be referred to as a "recorded medium," a "recording medium," a "recording paper," or a "recording sheet."

In such an image forming apparatus, a user may use ink other than a specific ink, such as a manufacturer's designated ink, a "recommended" ink, or a "genuine" ink. While this can be a cause for troubles such as image defect or failure, some users prefer non-genuine products for cost-reducing purposes, aware of the potential troubles that the non-specific item may cause. Some other users may purchase and use non-genuine products without knowing it. Technologies for preventing the use of products other than a specific product are proposed in Japanese Laid-Open Patent Applications No. 2000-326518 and 2004-188635; Japanese Patent No. 3095008; and Japanese Laid-Open Patent Application No. 2001-075455.

Japanese Laid-Open Patent Application No. 2006-276709 discloses an image forming apparatus in which use of a non-genuine product can be appropriately reflected in leasing charge. Japanese Laid-Open Patent Applications No. 2005-288845 and 2005-193522 disclose image forming apparatuses in which, instead of restricting a printing operation, a maintenance operation is performed to prevent failure or other troubles upon detection of use of a non-genuine product.

Although measures have been taken from the maintenance aspect as mentioned above in response to the use of non-specific products, no consideration is given with regard to the quality of an output image. As a practical matter, differences in ink material may lead to problems such as a failure to discharge an intended amount of ink, or a drop in landing position accuracy. Furthermore, because the amount of ink that a sheet can absorb varies depending on the type of ink, the probability of image quality deterioration such as beading increases when an excessive amount of ink attaches to the sheet.

In some inkjet printers, a recording head and an ink tank are integrated. In this case, a user may also use a recording head other than a specific head, such as one recommended by the manufacturer. If that happens, an intended amount of ink may not be discharged, or landing position accuracy may decrease.

Another example of the potential use of a non-specific product is the recording media (such as a sheet of paper). Many users are unaware of the characteristics of a recording medium they print on. Many users also tend to select non-specific recording media, which may be called a "glossy sheet," a "photographic sheet," or a "high-quality paper," simply because they are less expensive. In such a case too, because different sheets have different ink absorption amounts, excessive ink attachment may occur, resulting in beading or other image quality degradation. Because such various recording media also have different thicknesses, it may become impossible to cause an ink droplet to become attached to a target landing position.

Thus, the image quality may greatly drop below the optimum quality when even any one of the factors of ink, recording head, and recording medium is changed.

It is therefore a general object of the present invention to overcome the aforementioned problems. A more specific object is to provide an image forming apparatus capable of producing a high-quality image even when an expendable supply such as ink, a recording head, or a recording medium that is not a specific product is used.

DISCLOSURE OF THE INVENTION

In one embodiment, the invention provides an image forming apparatus configured to move a recording head including plural nozzles in a horizontal scan direction in order to record a recording medium by discharging ink via the nozzles onto the recording medium. The image forming apparatus includes a detection unit configured to detect whether one or more expendable supplies required for image formation are specific expendable supplies; and a notifying unit configured to notify an operator upon detection by the detection unit of a non-specific expendable supply, and configured to suggest to a user that an image forming method that is currently set be changed.

In another embodiment, the invention provides an image forming apparatus configured to move a recording head including plural nozzles in a horizontal scan direction in order to record a recording medium by discharging ink via the nozzles onto the recording medium. The image forming apparatus includes a detection unit configured to detect whether one or more expendable supplies required for image formation are specific expendable supplies; a notifying unit configured to notify an operator upon detection of a non-specific expendable supply; and an image forming method changing unit configured to automatically change an image forming method that is currently set.

In a preferred embodiment, the image forming method changing unit is configured to allow the operator to make a setting regarding whether the changing of the image forming method is to be made automatically or not.

In another preferred embodiment, the detection unit is configured to detect a non-specific expendable supply automatically using an automatic detection unit or manually based on an operator input.

In another preferred embodiment, the automatic detection unit is configured to examine an ink cartridge having a storage unit configured to store information about an ink use period. The automatic detection unit detects that the ink is not a specific expendable supply when the use period of the ink is longer than a specific period.

In another embodiment, the automatic detection unit is configured to examine an ink cartridge having a storage unit configured to store information about an accumulated amount of the ink used. The automatic detection unit detects that the ink is not a specific expendable supply when the accumulated amount of the ink used is greater than a specific amount.

In yet another embodiment, the automatic detection unit is configured to examine the recording head and identify a unique ID stored in a storage unit provided in the recording head. The automatic detection unit detects that the recording head is not a specific expendable supply when the unique ID does not correspond to a specific ID at the start of recording.

In yet another embodiment, the automatic detection unit is configured to examine a transport path in which a sensor for detecting a thickness of the recording medium is provided. The automatic detection unit detects that the recording medium is not a specific expendable supply when the thickness detected by the sensor at the start of recording is not within a specific range of values.

In yet another embodiment, the automatic detection unit is configured to examine a transport path in which a sensor for detecting a basis weight of the recording medium is provided. The automatic detection unit detects that the recording medium is not a specific expendable supply when the basis weight detected by the sensor at the start of recording is not within a specific range of values.

In yet another embodiment, the changing of the image forming method involves reducing the speed of movement of the carriage.

In another preferred embodiment, the changing of the image forming method involves increasing the number of scan passes made by the recording head for image formation.

In another preferred embodiment, the changing of the image forming method involves reducing the number of droplet sizes for gradation expression.

In another preferred embodiment, the changing of the image forming method involves changing a bidirectional printing to a one-directional printing.

In another preferred embodiment, the changing of the image forming method involves reducing the number of lines in halftone processing.

In another preferred embodiment, the changing of the image forming method involves reducing the amount of ink that attaches to the recording medium per unit area.

In another preferred embodiment, the changing of the image forming method involves eliminating a use of a color ink when generating colors of black and gray.

In another preferred embodiment, the changing of the image forming method involves reducing an amount of a color ink used for generating colors of black and gray.

The changing of the image forming method may involve extending a standby time between successive vertical scan operations.

The changing of the image forming method may involve extending a standby time for each of plural pages that are recorded successively.

The changing of the image forming method may be carried out near a border of the recording medium when a borderless printing is performed on the recording medium.

The changing of the image forming method may involve extending a standby time that is provided in an interval between a switching of recording surfaces when printing both top and bottom surfaces of the recording medium successively.

In accordance with the present invention, a high-quality image can be provided even when an ink, a recording head, or a recording medium that is not a specific ink, recording head, or recording medium is used.

BRIEF DESCRIPTION OF THE DRAWINGS

These and other objects, features and advantages of the invention will be apparent to those skilled in the art from the following detailed description of the invention, when read in conjunction with the accompanying drawings in which:

FIG. 31 shows an example of how an image forming method is changed depending on whether an expendable supply is a specific product.

BEST MODE FOR CARRYING OUT THE INVENTION

In the following, an inkjet recording apparatus, which is an image forming apparatus, according to an embodiment of the invention is described with reference to the drawings.

Figure 1:
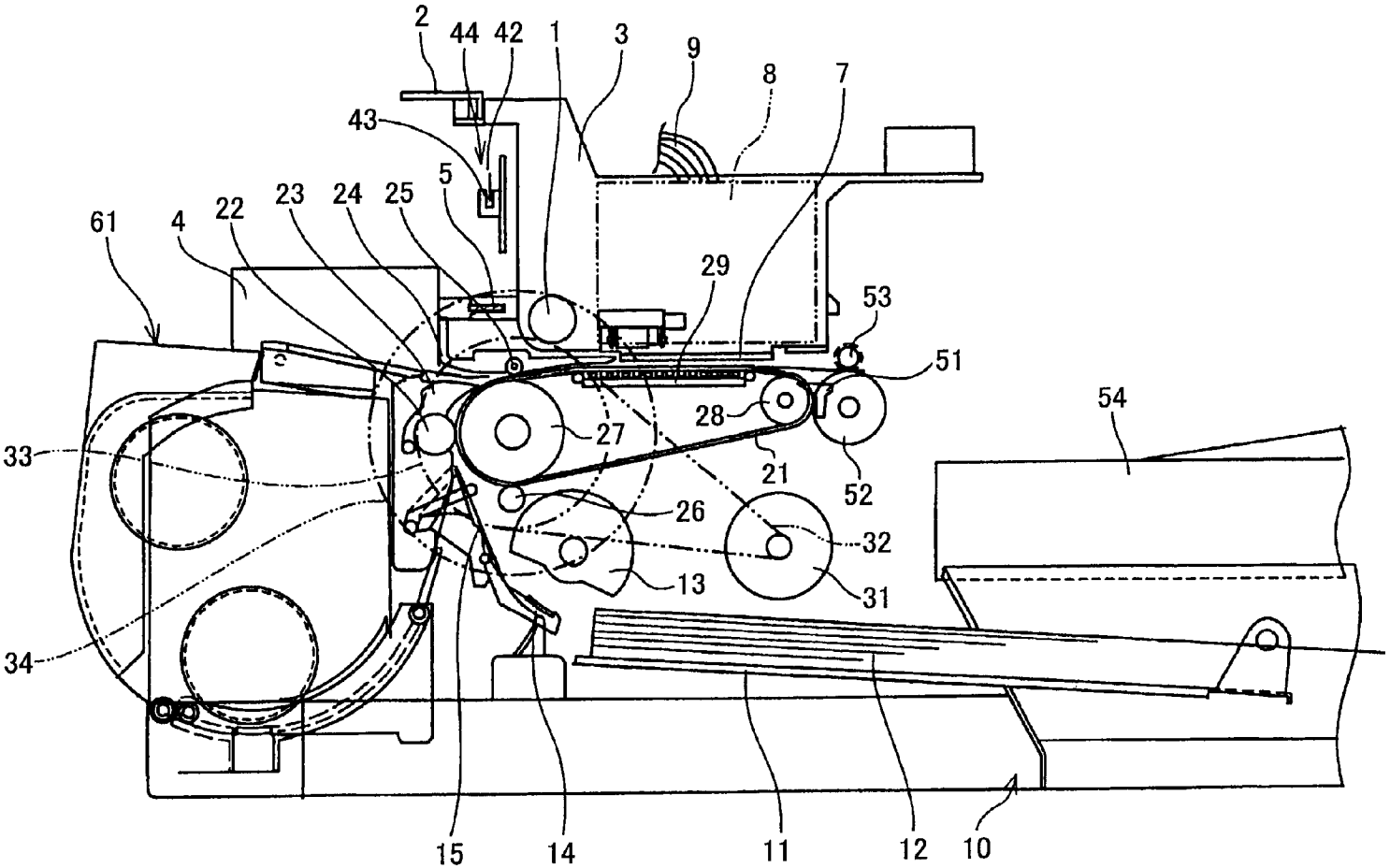
FIG. 1 shows a side view of a mechanism portion of an image forming apparatus that outputs image data generated by an image processing method according to an embodiment of the present invention.
Figure 2:
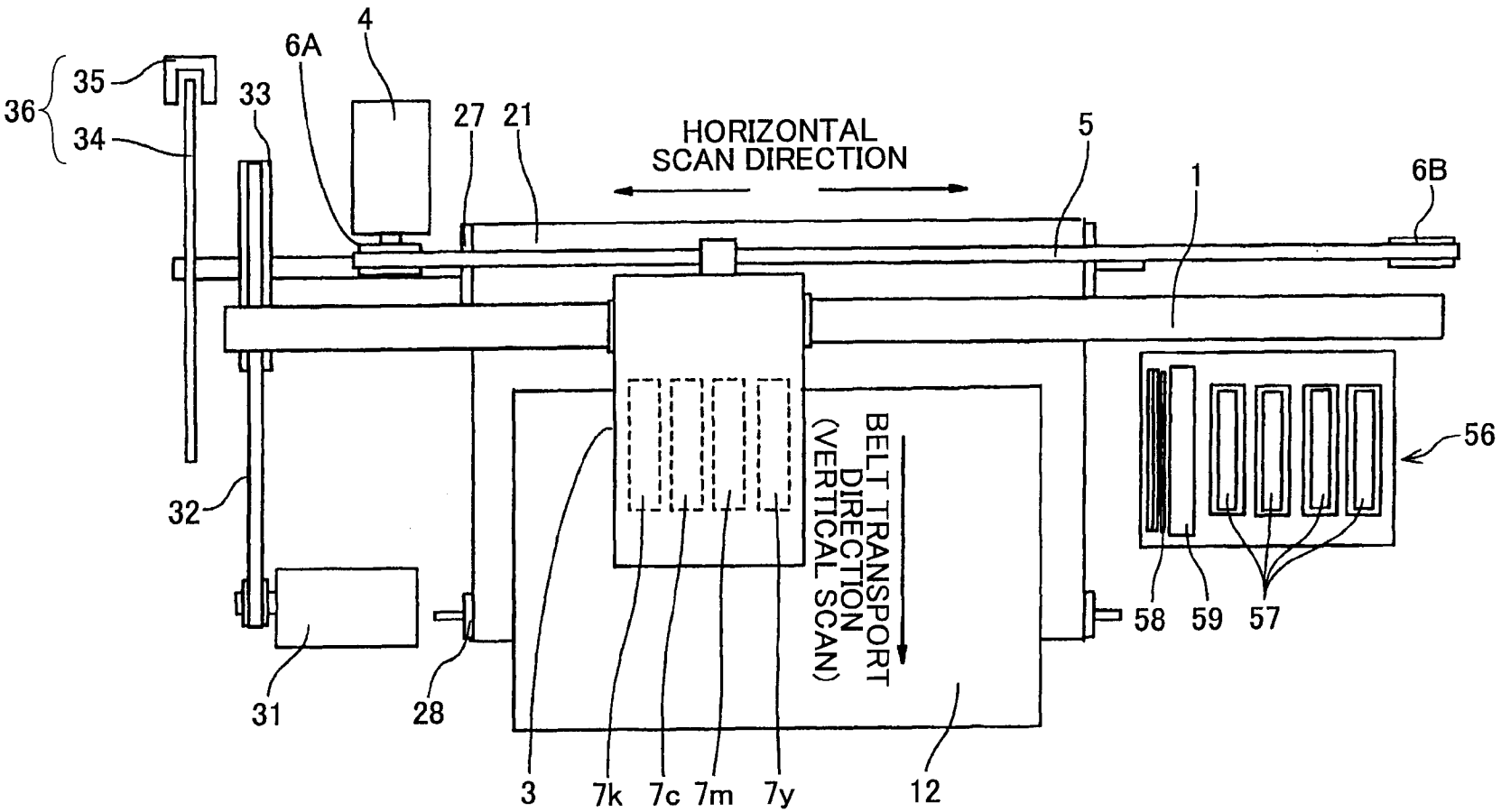
FIG. 2 shows a plan view of a main portion of the mechanism portion shown in FIG. 1.

FIGS. 1 and 2 show the image forming apparatus, which outputs image data generated by an image processing method according to an embodiment of the present invention. FIG. 1 shows a side view of a mechanism portion of the image forming apparatus. FIG. 2 shows a plan view of the mechanism portion.

The image forming apparatus according to the present embodiment includes a carriage 3 supported by a guide rod 1 and a guide rail 2 in such a manner as to be slidable in a horizontal scan direction. The guide rod 1 and the guide rail 2 are guide members laterally mounted on the left- and right-side plates (not shown). The carriage 3 is moved in the directions indicated by arrows in FIG. 2 (horizontal scan direction) by a horizontal scan motor 4, via a timing belt 5 extended between a drive pulley 6A and a driven pulley 6B.

The carriage 3 may carry four recording heads 7*y*, 7*c*, 7*m*, and 7*k* (which may be referred to collectively as a "recording head 7" when no distinctions are made between the individual colors). These recording heads are liquid discharge heads for discharging ink droplets of yellow (Y), cyan (C), magenta (M), and black (K). The individual ink discharge openings of the four recording heads 7*y*, 7*c*, 7*m*, and 7*k* may be arranged in a direction perpendicular to the horizontal scan direction, with the direction of ink discharge facing downward.

Each of the liquid discharge heads, of which the recording head 7 is composed, has a pressure generator for generating the pressure for discharging a droplet. Examples of the pressure generator include a piezoelectric actuator; a thermal actuator that utilizes a phase change caused by liquid film boiling produced by an electric-thermal conversion element, such as a heating resistor; a shape-memory alloy actuator utilizing a metal phase change due to temperature change; or an electrostatic actuator utilizing electrostatic force. The individual head units provided for the individual colors are merely an example. In another embodiment, the recording head 7 may consist of one or more liquid discharge head units having a line of nozzles for discharging droplets of multiple colors.

The carriage 3 also carries sub-tanks 8 for supplying ink of individual colors to the recording head 7. To each of the sub-tanks 8, ink is supplied via an ink supply tube 9 from a main tank (ink cartridge), which is not shown. While in the present embodiment ink is supplied from the external main tanks, this is merely an example. In another embodiment, the ink cartridges may be mounted at the position of the sub-tanks 8.

The image forming apparatus further includes a sheet feeding unit for supplying a sheet 12 placed on a sheet tray 11, such as a sheet-feeding cassette 10. The sheet feeding unit includes a half-moon shaped roller (sheet-feeding roller) 13 for picking up and sending the sheet 12 from the sheet tray 11, one sheet at a time. The sheet feeding unit also includes a separating pad 14 disposed opposite the sheet-feeding roller 13. The separating pad 14, which is made of material with a large friction coefficient, is biased toward the sheet-feeding roller 13.

In order to transport the sheet 12 fed by the sheet feeding unit under the recording head 7, there are provided a transfer belt 21 for transporting the sheet 12 using electrostatic adsorption; a counter roller 22 for transporting the sheet 12, as it is fed from the sheet feeding unit via a guide 15, between the counter roller 22 and a transfer belt 21; a transport guide 23 for changing the direction of the sheet 12 by substantially 90°, so that the sheet 12 can follow along the transfer belt 21; and a holddown roller 25 that is biased toward the transfer belt 21 by a holddown member 24. There is also provided a charge roller 26 for charging the surface of the transfer belt 21.

The transfer belt 21 is an endless belt extended between a transfer roller 27 and a tension roller 28. As the transfer roller 27 is rotated by a vertical scan motor 31 via a timing belt 32 and a timing roller 33, the transfer belt 21 turns in a belt transport direction (vertical scan direction) indicated by an arrow in FIG. 2. Facing the back side of the transfer belt 21, a guide member 29 is disposed at a location corresponding to an image formation region of the recording head 7. The charge roller 26 is in contact with the surface layer of the transfer belt 21 so that it can rotate in accordance with the turning of the transfer belt 21.

As shown in FIG. 2, a disc 34 having slits is attached to the shaft of the transfer roller 27. A sensor 35 is provided to detect the slits of the disc 34. The disc 34 and the sensor 35 form a rotary encoder 36.

The image forming apparatus further includes a paper ejection unit for ejecting the sheet 12 that has been recorded by the recording head 7. The paper ejection unit comprises a separating nail 51 for separating the sheet 12 from the transfer belt 21; paper ejection rollers 52 and 53; and an ejected paper tray 54 for stocking the ejected sheet 12.

In a back portion, a both-side sheet-feeding unit 61 is detachably attached. The both-side sheet-feeding unit 61 is configured to take the sheet 12 as it is returned by the rotation of the transfer belt 21 in the opposite direction, invert the sheet 12, and then feed it again between the counter roller 22 and the transfer belt 21.

As shown in FIG. 2, in a non-printing region on one side of the carriage 3 along the horizontal scan direction, a maintain/recover mechanism 56 for maintaining or recovering the condition of the nozzles of the recording head 7 is disposed.

This maintain/recover mechanism 56 includes caps 57 for capping the nozzle surface of each of the recording heads 7, a wiper blade 58 which is a blade member for wiping the nozzle surface, and a blank discharge receiver 59 for receiving droplets when performing a blank discharge involving the discharge of droplets that do not contribute to recording for the purpose of ejecting recording fluid having increased viscosity.

In the thus constructed image forming apparatus, the sheet 12 is fed from the sheet feeding unit one by one. The sheet 12 is guided by the guide 15 substantially vertically upwardly and then transferred sandwiched between the transfer belt 21 and the counter roller 22. The tip of the sheet 12 is guided by the transport guide 23, and the sheet 12 is held down onto the transfer belt 21 by the holddown roller 25, whereby the direction of transport is changed by substantially 90°.

A control unit (not shown) causes an AC bias supply unit to apply an alternating voltage which alternates between positive and negative levels to the charge roller 26. As a result, the transfer belt 21 is charged with an alternating charge voltage pattern in which positive and negative levels appear alternately at predetermined individual durations in the rotating direction, i.e., the vertical scan direction. When the sheet 12 is fed onto the thus charged transfer belt 21, the sheet 12 is adsorbed onto the transfer belt 21 by electrostatic force, so that the sheet 12 can be transported in the vertical scan direction as the transfer belt 21 rotates.

The recording head 7 is driven in accordance with an image signal while the carriage 3 is moved in the forward or the backward direction, whereby ink droplets are discharged onto the stationary sheet 12, thus recording one line of data. The sheet 12 is then moved a predetermined distance, followed by the recording of the next line. Upon reception of a record end signal or a signal indicating that the bottom end of the sheet 12 has reached the recording region, the recording operation is stopped, and the sheet 12 is ejected to the ejected paper tray 54.

In the case of a both-side printing, the transfer belt 21 is rotated in the opposite direction upon completion of the recording on the upper surface (which is initially printed). Thereby, the recorded sheet 12 is sent into the both-side sheet-feeding unit 61, in which the sheet 12 is inverted (so that the back surface is made the printed surface). Thereafter, the sheet 12 is again fed between the counter roller 22 and the transfer belt 21, carried on the transfer belt 21 while timing control is performed. The sheet is recorded on the back surface in the same way as described above, and finally ejected onto the ejected paper tray 54.

During a print (record) standby period, the carriage 3 is moved toward the maintain/recover mechanism 55, where the nozzle surfaces of the recording head 7 are capped with the caps 57 so that the nozzles can maintain their wet condition to thereby prevent discharge failure due to the drying of ink. Further, with the recording head 7 capped with the caps 57, a recovery operation may be performed in which the recording fluid is sucked out of the nozzles in order to discharge the recording fluid having increased viscosity or bubbles. This is followed by wiping with the wiper blade 58, whereby the ink that has become attached to the nozzle surfaces of the recording head 7 due to the recovery operation is cleared or removed. Before or during recording, a blank discharge operation may be performed in which ink that does not contribute to recording is discharged. In this way, a stable discharge performance of the recording head 7 is maintained.

Figure 3:
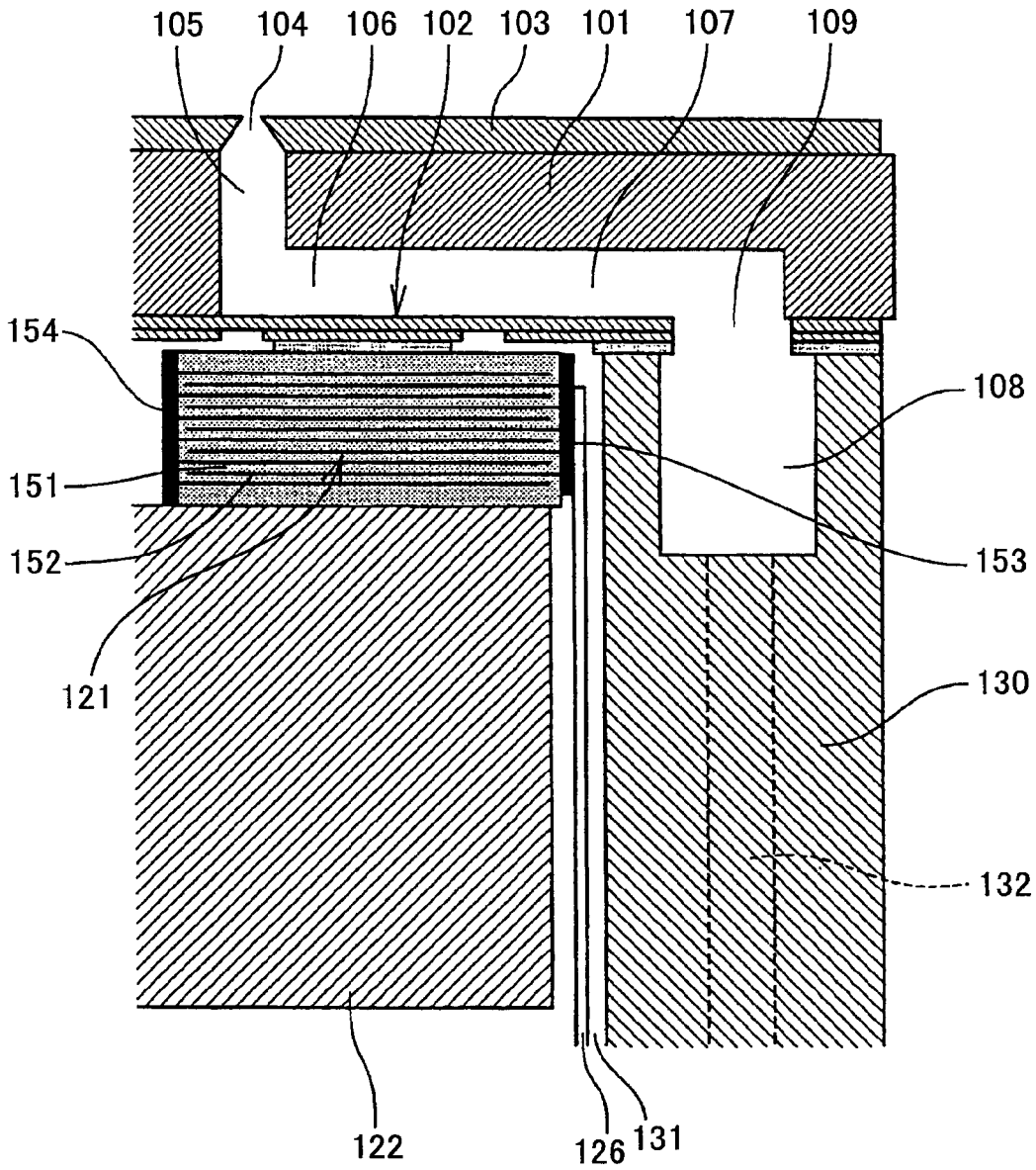
FIG. 3 shows a cross section taken along the longer direction of a fluid chamber of a recording head in the image forming apparatus.
Figure 4:
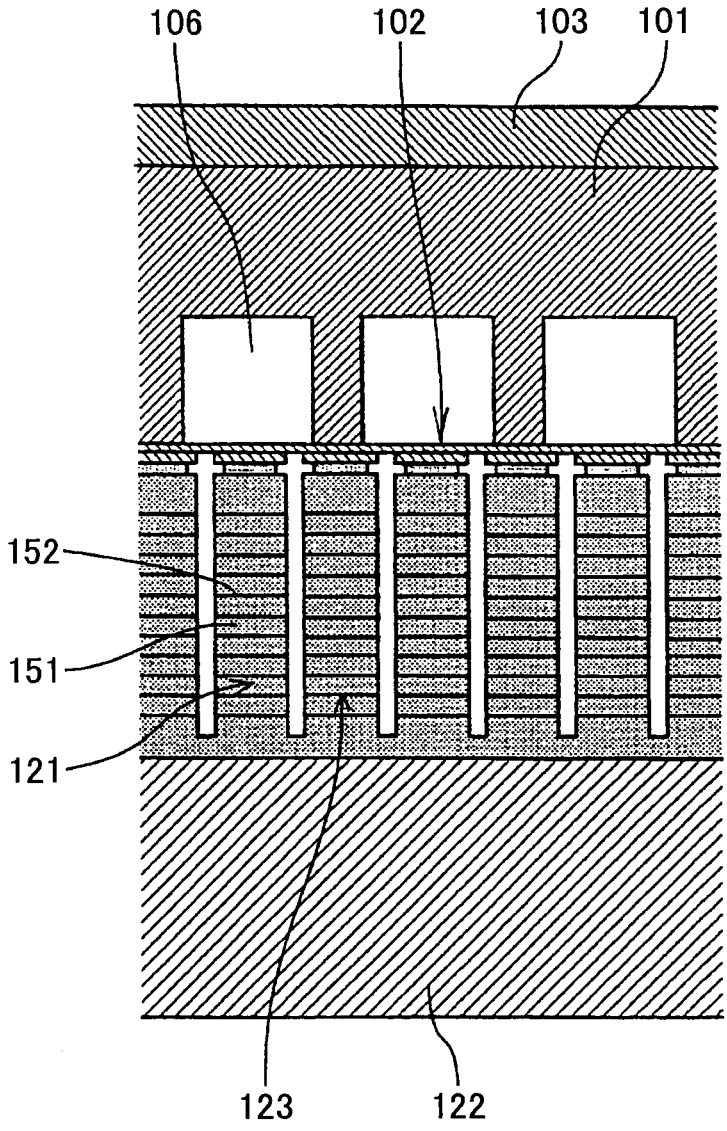
FIG. 4 shows a cross section taken along the shorter direction of the fluid chamber of the recording head.

Hereafter, an example of the liquid discharge head, i.e., the recording head 7, is described with reference to FIGS. 3 and 4. FIG. 3 shows a cross section of the head taken along the longer direction of a fluid chamber. FIG. 4 shows a cross section taken in the shorter direction of the fluid chamber (along which the nozzles are arranged).

The liquid discharge head includes a channel plate 101, which may be formed by anisotropic etching of a single-crystal silicon substrate. A vibrating plate 102, which may be formed by nickel electroforming, is joined to a bottom surface of the channel plate 101. A nozzle plate 103 is joined to an upper surface of the channel plate 101. In these laminated layers, there are formed a nozzle communication passage 105 with which a nozzle 104 for discharging an ink droplet is in fluid communication; a fluid chamber 106 which is a pressure generating chamber; and an ink supply opening 109 with which a common fluid chamber 108 is in fluid communication in order to supply ink to the fluid chamber 106 via a fluid resistance portion (supply passage) 107.

The liquid discharge head also includes two lines of laminated piezoelectric elements 121 (In FIG. 4, only one line of the laminated piezoelectric element 121 is shown). The laminated piezoelectric element 121 is an electromechanical transducer element as a pressure generator (actuator unit) configured to deform the vibrating plate 102 in order to apply pressure to the ink in the fluid chamber 106. The piezoelectric element 121 is fixed to a base substrate 122. Between the piezoelectric elements 121, a support portion 123 is provided. The support portion 123 is formed simultaneously with the piezoelectric elements 121 by dividing the piezoelectric element material. Because no drive voltage is applied to the support portion 123, it merely functions as a support.

To the piezoelectric element 121, a flexible printed circuit board (FPC) cable 126 equipped with a drive circuit (drive IC), not shown, is connected.

A peripheral portion of the vibrating plate 102 is joined to a frame member 130. In the frame member 130, there are formed a bored portion 131 for housing the actuator unit including the piezoelectric element 121 and the base substrate 122; a depressed portion for the common fluid chamber 108; and an ink supply opening 132 for supplying external color ink to the common fluid chamber 108. The frame member 130 may be formed by injection molding of a thermosetting resin, such as epoxy resin or polyphenylene sulfide.

The depressions or openings in the channel plate 101, such as the nozzle communication passage 105 and the fluid chamber 106, may be formed by anisotropic etching of a single-crystal silicon substrate having the crystal face orientation (110), using an alkaline etching solution, such as an aqueous solution of potassium hydroxide (KOH). However, the substrate is not limited to a single-crystal silicon substrate but may be a stainless substrate or a photosensitive resin.

The vibrating plate 102 may be made of a nickel metal plate by electroforming process. In another embodiment, the vibrating plate 102 may be made of other types of metal plate, or of a metal-resin composite material. To the vibrating plate 102, the piezoelectric elements 121 and the support portion 123 are bonded with adhesive. The frame member 130 is also bonded to the vibrating plate 102 with adhesive.

The nozzle plate 103 has the nozzle 104 formed therein for each fluid chamber 106, with a diameter of 10 to 30 μm. The nozzle plate 103 is bonded to the channel plate 101 with adhesive. The nozzle plate 103 is made of a metal nozzle forming member on the outer-most surface of which a water-repellent layer is formed via any required layers.

The piezoelectric element 121 is a piezoelectric transducer (PZT) consisting of a piezoelectric material 151 and internal electrodes 152 that are alternately laminated. The internal electrodes 152 are drawn out of the piezoelectric element 121 via alternately different end faces thereof, and are connected to an individual electrode 153 or a common electrode 154. In the present embodiment, the piezoelectric element 121 employs displacement in the d33 direction as the piezoelectric direction in order to apply pressure to the ink in the fluid chamber 106. Alternatively, displacement in the d31 direction may be employed as the piezoelectric direction of the piezoelectric element 121 in order to apply pressure to the ink in the fluid chamber 106. In another embodiment, one line of the piezoelectric element 121 may be provided on a single substrate 122.

In the thus constructed liquid discharge head, when the voltage applied to the piezoelectric element 121 is lowered below a reference potential, the piezoelectric element 121 contracts, whereby the vibrating plate 102 moves downward. As a result, the volume of the fluid chamber 106 expands, causing ink to flow into the fluid chamber 106. Thereafter, the voltage applied to the piezoelectric element 121 is increased in order to cause the piezoelectric element 121 to extend in the laminated direction, thereby deforming the vibrating plate 102 in the direction of the nozzle 104. As a result, the volume of the fluid chamber 106 decreases, whereby the recording fluid in the fluid chamber 106 is pressurized and discharged (ejected) out of the nozzle 104 in the form of a droplet.

By bringing the voltage applied to the piezoelectric element 121 back to the reference potential, the vibrating plate 102 returns to its initial position, whereby the fluid chamber 106 expands and a negative pressure is generated. The negative pressure causes the fluid chamber 106 to be filled with the recording fluid from the common fluid chamber 108. After the vibration of the meniscus surface at the nozzle 104 dampens to a stable state, an operation for the discharge of the next droplet is initiated.

The above (pull-push discharge process) is merely an example of the method of driving the head. A pull discharge or a push discharge process may be employed depending on the way a drive waveform is given.

Figure 5:
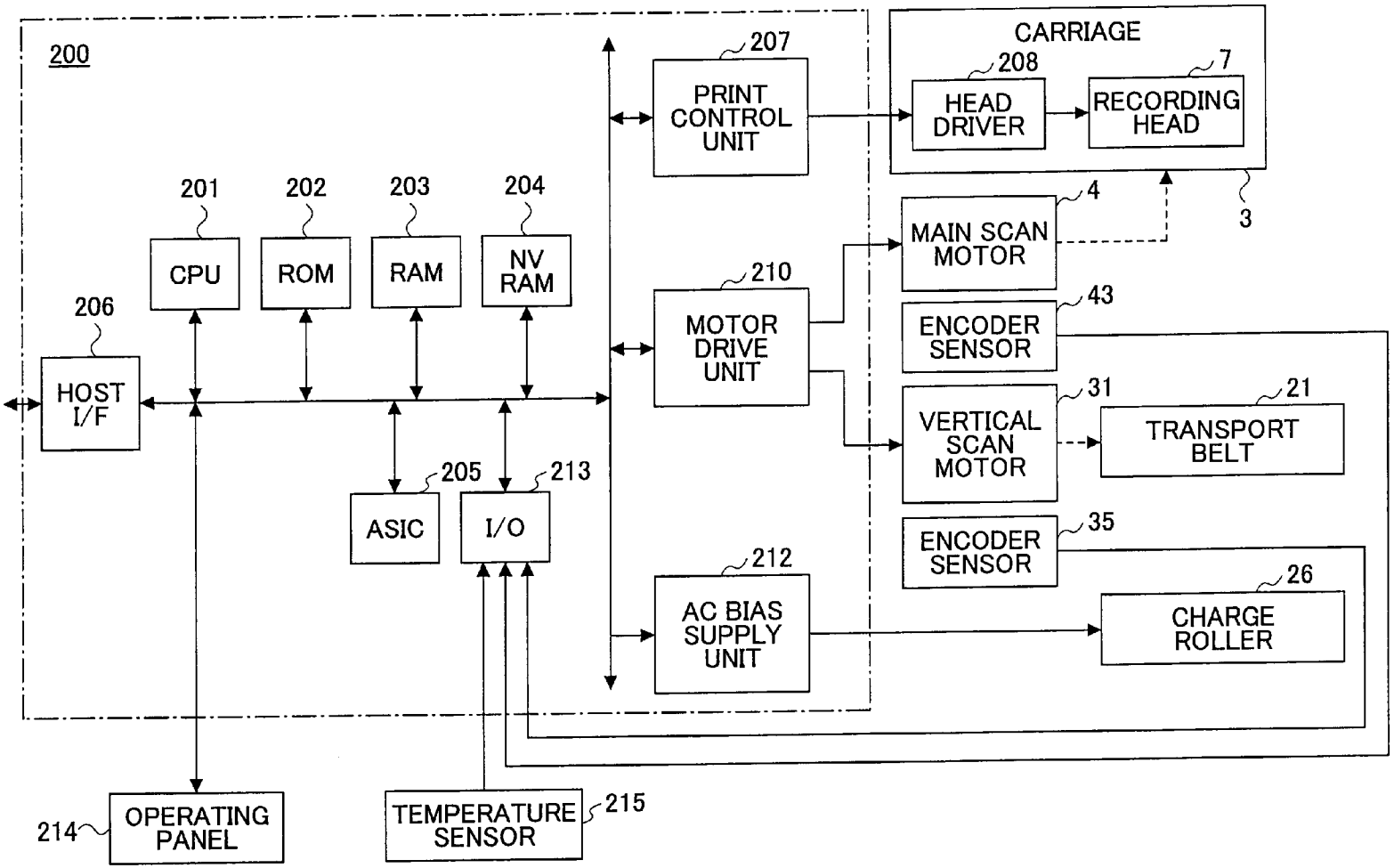
FIG. 5 shows a block diagram of a control unit of the image forming apparatus.

Hereafter, the control unit of the image forming apparatus is described with reference to a block diagram shown in FIG. 5.

The control unit 200 includes a central processing unit (CPU) 201 for controlling the apparatus as a whole; a read-only memory (ROM) for storing a program executed by the CPU 201 and other fixed data; a random access memory (RAM) 203 which may temporarily store image data; a rewritable nonvolatile memory 204 for retaining data when power to the apparatus is turned off; and an application-specific integrated circuit (ASIC) 205 for performing various signal processes on image data, image processing for data rearrangement, and an input/output signal processing for controlling the apparatus as a whole.

The control unit 200 also includes an interface (I/F) 206 for exchanging data and signals with a host; a data transfer unit for driving and controlling the recording head 7; a print control unit 207 including a drive waveform generating unit for generating a drive waveform; a head driver (driver IC) 208 for driving the recording head 7 mounted on the carriage 3; a motor drive unit 210 for driving the horizontal scan motor 4 and the vertical scan motor 31; an AC bias supply unit 212 for supplying an AC bias to the charge roller 34; and an input/output (I/O) unit 213 for the input of detection signals from various sensors such as encoder sensors 43 and 35 and a temperature sensor for detecting ambient temperature. Further, an operating panel 214 for the input and display of necessary information is connected to the control unit 200.

The control unit 200 receives image data from a host via the I/F 206. The host may be an information processing apparatus such as a personal computer, an image reading apparatus such as an image scanner, or an imaging device such as a digital camera, connected via a cable or a network.

The CPU 201 of the control unit 200 reads and analyzes print data in a reception buffer included in the I/F 206, performs necessary image processing in the ASIC 205 in order to rearrange the data, for example, and then transfers the image data from the head drive control unit 207 to the head driver 208. The generation of dot pattern data for the output of an image is performed by a printer driver on the host end, as will be described later.

The print control unit 207 transfers the aforementioned image data to the head driver 208 in the form of serial data. The print control unit 207 also outputs to the head driver 208 a transfer clock and a latch signal, which are necessary for transfer of image data and for finalizing transfer, and a drop control signal (mask signal). The print control unit 207 also includes a drive waveform generating unit including a D/A converter for D/A converting drive signal pattern data stored in the ROM, a voltage amplifier, and a current amplifier. The print control unit 207 further includes a drive waveform selection unit for selecting a drive waveform to be fed to the head driver. Using these units, the print control unit 207 generates a drive waveform consisting of one or more drive pulses (drive signals) and outputs the drive waveform to the head driver 208.

The head driver 208, based on the serially fed image data corresponding to one line to be recorded with the recording head 7, drives the recording head 7 by selectively applying a drive signal corresponding to the drive waveform fed from the print control unit 207 to the drive elements (such as the aforementioned piezoelectric elements) for generating the energy for causing the discharge of droplets out of the recording head 7. By selecting an appropriate drive pulse of which the drive waveform is composed, dots having various sizes, such as large, medium, or small dots, can be discharged.

A speed detection value and a position detection value are obtained by sampling a detection pulse from the encoder sensor 43, which is a linear encoder. A target speed value and a target position value are obtained from a pre-stored speed/position profile. Based on these values, the CPU 201 calculates a drive output value (control value) and then drives the horizontal scan motor 4 via the motor drive unit 210 based on the control value. Similarly, a speed detection value and a position detection value are obtained by sampling a detection pulse from the encoder sensor 35, which is a rotary encoder. A target speed value and a target position value are obtained from a pre-stored speed/position profile. Based on these values, the CPU 201 calculates a drive output value (control value), and then drives the vertical scan motor 31 via the motor drive unit 210 and a motor driver based on the control value.

Figure 6:
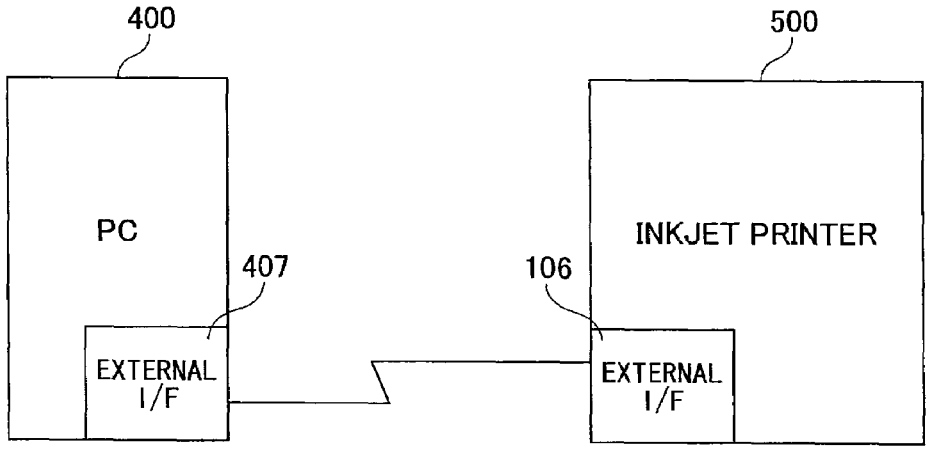
FIG. 6 shows a block diagram of an image forming system according to an embodiment of the present invention.

Hereafter, an image forming system according to an embodiment of the present invention is described with reference to FIG. 6. The system includes one or more image processing apparatuses 400 and an inkjet printer 500 (inkjet recording apparatus) corresponding to the aforementioned image forming apparatus.

The image processing apparatus 400, which may be a personal computer (PC), and the inkjet printer 500 are connected via a predetermined interface or a network.

Figure 7:
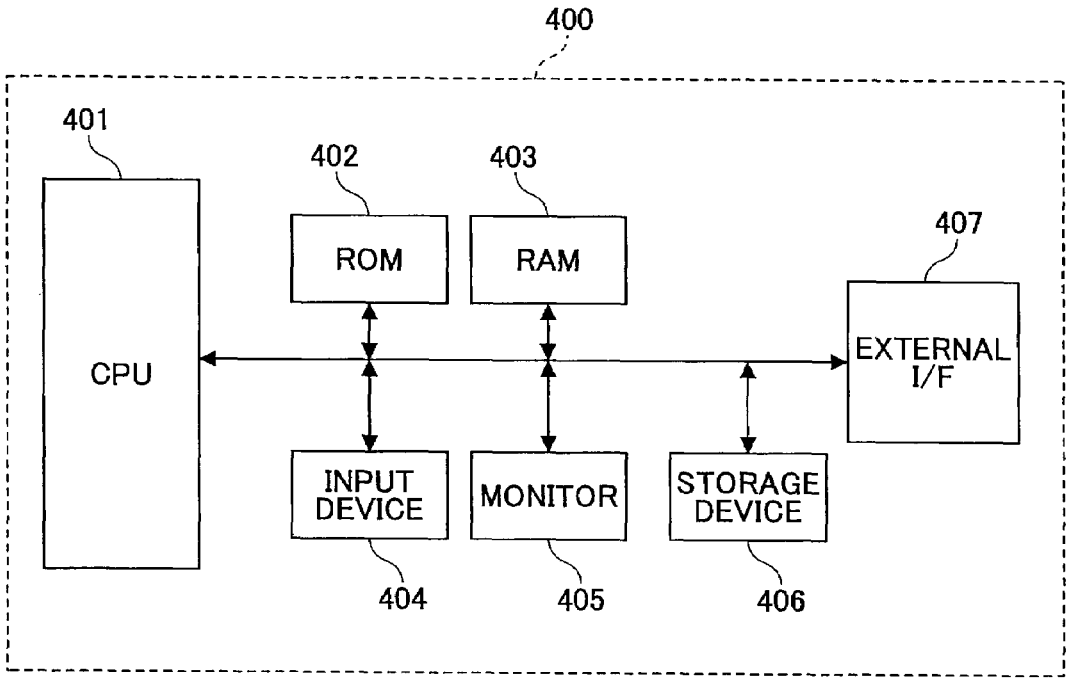
FIG. 7 shows a block diagram of an image processing apparatus in the image forming system.

The image processing apparatus 400 includes a CPU 401 and various memory units, such as a ROM 402 and a RAM 403, which are connected by a bus line, as shown in FIG. 7. Various units are connected to the bus line via predetermined interfaces, such as a storage unit 406 which may consist of a magnetic storage unit such as a hard disk; an input device 404 such as a mouse or a keyboard; a monitor 405 such as a liquid crystal display (LCD) or a cathode-ray tube (CRT) display; and a storage medium reading device (not shown) for reading a storage medium such as an optical disc. A predetermined interface (external I/F) unit 407 for communication with an external network such as the Internet or an external device via USB connection is also connected to the bus line.

The storage unit 406 of the image processing apparatus 400 stores an image processing program. The image processing program may be read from a storage medium using the storage medium reading device, or downloaded from a network such as the Internet, and then installed on the storage unit 406. By thus installing the image processing program, the image processing apparatus 400 is enabled to perform image processing as described below. The image processing program may be adapted to operate on a predetermined operating system (OS). The image processing program may also constitute a part of particular application software.

Figure 8:
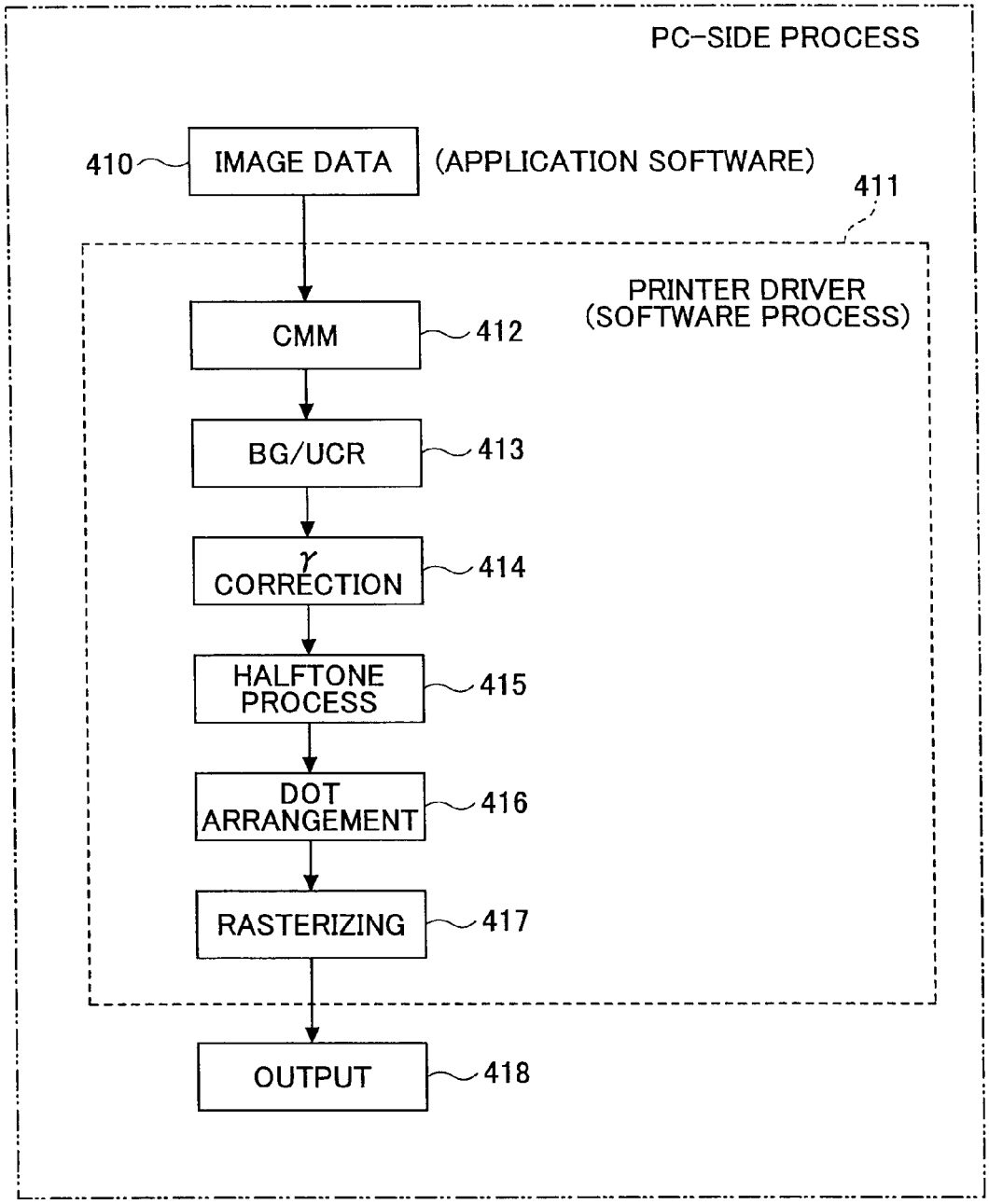
FIG. 8 shows a functional block diagram of a printer driver, which is a program according to an embodiment of the present invention.

With reference to a functional block diagram shown in FIG. 8, an image processing method using the program on the part of the image processing apparatus 400 according to an embodiment of the present invention is described.

This is an example in which most of imaging processes are carried out by a host computer such as a personal computer (PC) functioning as an image processing apparatus, as is suitable in the case of a relatively low-cost inkjet recording apparatus.

A printer driver 411 includes the program stored in the image processing apparatus 400 (PC). The printer driver 411 includes a color management module (CMM) processing unit 412 for converting image data 410, which may be fed from application software, from a color space for monitor display into a color space for a recording apparatus, such as an image forming apparatus (i.e., from the RGB color system to the CMY color system); a black generation/under color removal (BG/UCR) processing unit 413 for black generation and under color removal from the CMY values; a γ correction processing unit 414 for correction of recording apparatus characteristics or input/output correction to suit a user's preferences; a halftone processing unit 415 for performing a halftone process on image data; a dot arrangement processing unit 416 (which may be incorporated into the halftone processing unit) for converting the result of halftone processing into a pattern arrangement corresponding to the order of ejection of dots from the recording apparatus; and a rasterizing unit 417 for spreading the dot pattern data, i.e., the print image data obtained by the halftone processing and the dot arrangement processing, in accordance with the print nozzle positions. An output 418 of the rasterizing unit 417 is delivered to the inkjet printer 500.

Hereafter, an example of performing part of the image processing according to the present embodiment on the part of the inkjet printer 500 is described with reference to a functional block diagram shown in FIG. 9.

This example enables high-speed processing, and may be suitably used in high-speed machines.

A printer driver 421 on the part of the image processing apparatus 400 (PC) includes a CMM processing unit 422 for converting image data 410, which may be fed from application software, from a color space for monitor display into a color space for a recording apparatus (i.e., from the RGB color system to the CMY color system); a BG/UCR processing unit 423 for black generation and under color removal from the CMY values; and a γ correction processing unit 424 for correction of recording apparatus characteristics or input/output correction to suit a user's preferences. Image data generated by the γ correction processing unit 424 is delivered to the inkjet printer 500.

A printer controller 511 (control unit 200) on the part of the inkjet printer 500 includes a halftone processing unit 415 for performing a halftone processing on image data; a dot arrangement processing unit 416 (which may be incorporated into the halftone processing unit) for converting the result of halftone processing into a pattern arrangement corresponding to the order of ejection of dots from the recording apparatus; and a rasterizing unit 517 for spreading the print image data, i.e., the dot pattern data obtained by the halftone processing and the dot arrangement processing, in accordance with the individual nozzle positions. The output of the rasterizing unit 517 is delivered to the print control unit 207.

Figure 9:
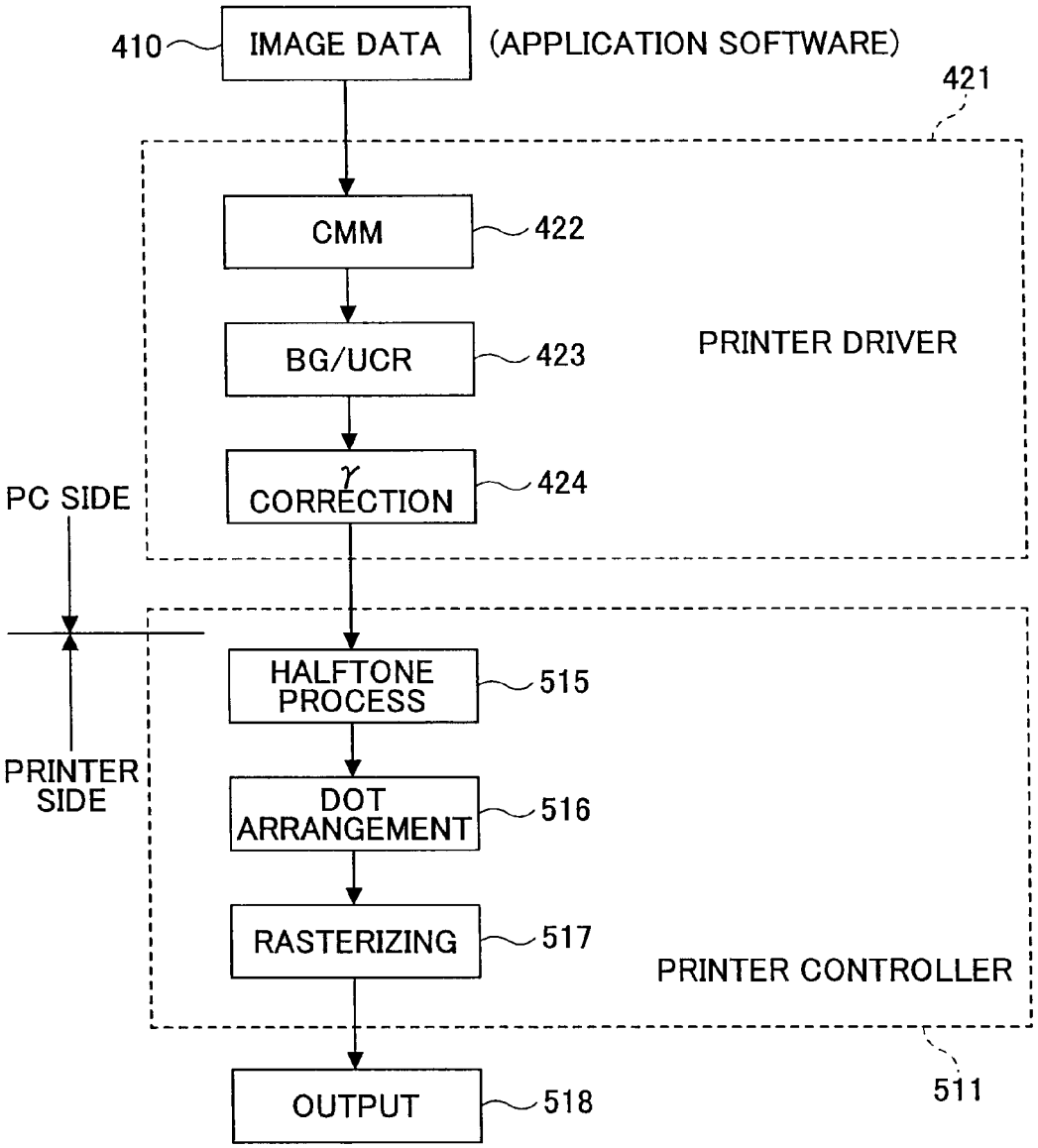
FIG. 9 shows a functional block diagram of another example of the printer driver.

The image processing method according to the present embodiment of the invention may be implemented by either the configuration of FIG. 8 or FIG. 9. In the following, reference is made to the configuration of FIG. 8, in which the inkjet recording apparatus does not have the function to generate a dot pattern that is actually recorded in response to a print instruction to draw an image or a character. Thus, a print instruction, which may be sent from application software executed by the image processing apparatus 400 as a host, is subjected to image processing by the printer driver 411, which is provided in the image processing apparatus 400 (host computer) in the form of software. The resultant multiple-value dot pattern data (print image data) that the inkjet printer 500 can output is then rasterized and transferred to the inkjet printer 500, which produces a printed output.

Specifically, in the image processing apparatus 400, an image-drawing or character-recording instruction from an application or the operating system (describing, e.g., the position, thickness, and shape of a line to be recorded, or the font and position of a character to be recorded) is temporarily saved in a rendering data memory. Such an instruction may be described in a particular print language.

The instruction saved in the rendering data memory is interpreted by the rasterizer. If it is a line-recording instruction, it is converted into a recording dot pattern corresponding to a designated position or thickness. If the instruction is a character-recording instruction, it is converted into a recording dot pattern corresponding to a designated position or size based on corresponding character profile information which is recalled from font outline data stored in the image processing apparatus (host computer) 400. In the case of image data, the data is converted into a recording dot pattern as is.

Thereafter, the recording dot pattern (image data 410) is image-processed and then stored in the raster data memory. Specifically, the image processing apparatus 400 rasterizes the data into recording dot pattern data with reference to orthogonal grids as reference recording positions. The image processing includes a color management module (CMM) processing for color adjustment; γ correction processing; halftone processing using a dither method or an error diffusion method; an underlayer eliminating processing; and a total ink amount regulating processing, some of which have been mentioned above. The recording dot pattern stored in the raster data memory is transferred to the inkjet recording apparatus 500 via an interface.

Figure 10:
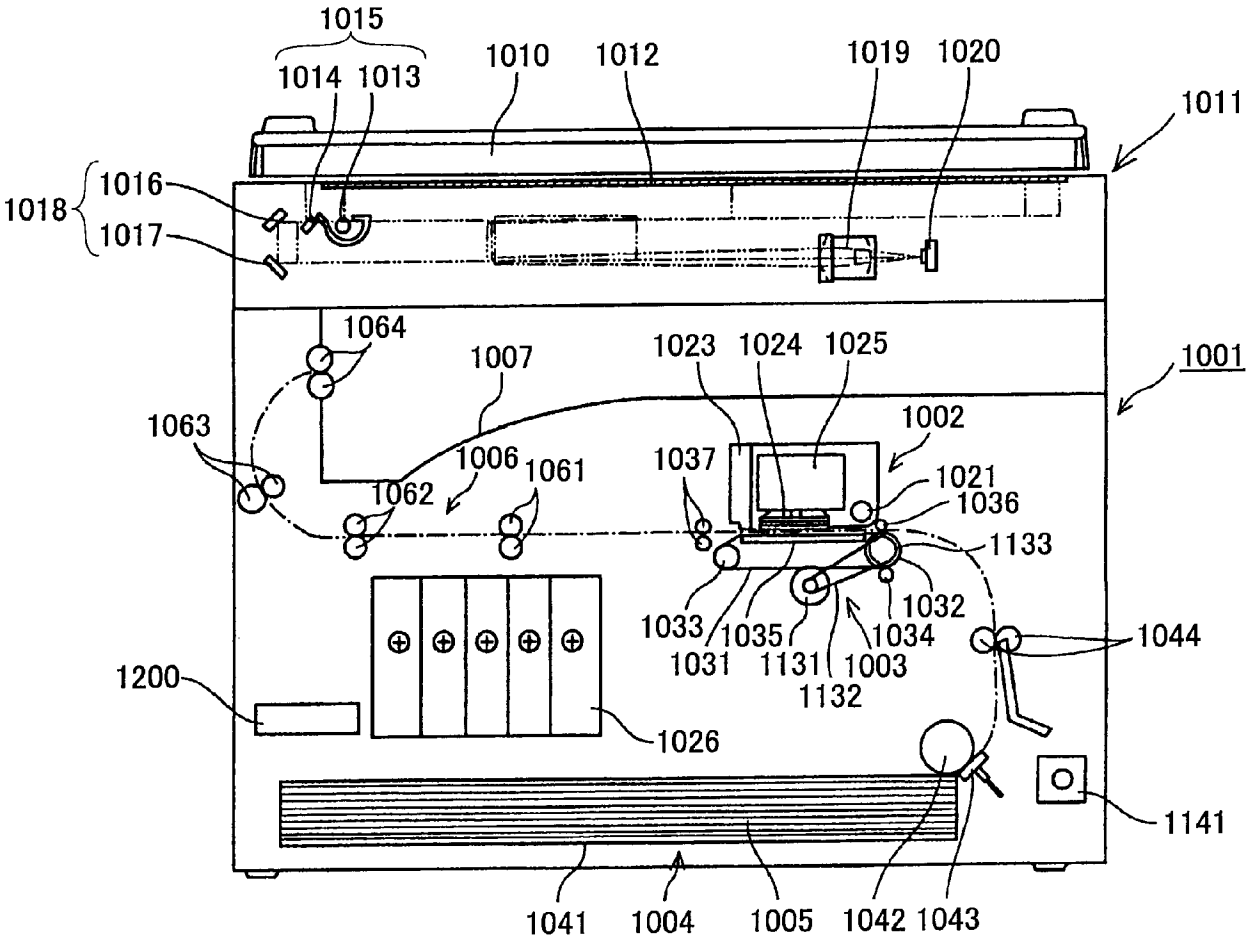
FIG. 10 shows an overall structure of an image forming apparatus according to an embodiment of the present invention.

In the following, an image forming apparatus (multifunction peripheral) combining the function of an inkjet recording apparatus and a copier function is described with reference to FIG. 10. FIG. 10 shows an overall structure of the image forming apparatus.

The image forming apparatus has an apparatus body (casing) 1001 in which an image forming unit 1002 for forming an image and a vertical scan transfer unit 1003 (which may be collectively referred to as a printer engine unit) are disposed. At the bottom of the apparatus body 1001, there is provided a sheet feeding unit 1004, from which a recording medium (sheet) 1005 is taken one by one. The sheet 1005 is then transported by a vertical scan transfer unit 1003 to a position opposite an image forming unit 1002, where the image forming unit 1002 discharges ink droplets onto the sheet 1005 to form (record) a required image. The sheet 1005 is then ejected onto an ejected paper tray 1007 formed at the top of the apparatus body 1001 via an ejected paper transfer unit 1006.

The image forming apparatus also includes an image reading unit (scanner unit) 1011 disposed above the ejected paper tray 1007 for reading an image. The image reading unit 1011, which is an input system for image data (print data) used by the image forming unit 1002, includes a scanning optical system 1015 including an illuminating light source 1013 and a mirror 1014, and another scanning optical system 1018 including mirrors 1016 and 1017. The scanning optical systems 1015 and 1018 are configured to move in order to acquire an image of a manuscript placed on a contact glass 1012. The scanned manuscript image is then acquired as an image signal by an image reading element 1020 disposed behind a lens 1019. The acquired image signal is digitized and subjected to image processing, and the image-processed print data can be then printed. Over the contact glass 1012, a cover plate 1010 for holding a manuscript is attached.

The image forming apparatus may be configured to receive data, such as print image data, from an external data input system, in order to input data for an image formed by the forming unit 1002. Examples of the external data input system include an information processing apparatus, such as a personal computer functioning as an image processing apparatus; an image reading device such as an image scanner; and an imaging device such as a digital camera. Such data including print image data delivered from a host may be received via a print cable or a network, processed, and then printed.

The image forming unit 1002 is of the shuttle type. Specifically, the image forming unit 1002, substantially similar to the aforementioned inkjet recording apparatus (image forming apparatus), includes a carriage 1023 adapted to be guided by a guide rod 1021 to move in the horizontal scan direction (perpendicular to the sheet transport direction). On the carriage 1023, there is disposed a recording head 1024 consisting of one or more liquid discharge heads, each of which has a line of nozzles for discharging droplets of multiple different colors. The recording head 1024 is configured to discharge droplets of ink while the carriage 1023 is moved by a carriage scan mechanism in the horizontal scan direction and while the sheet 1005 is transferred in the sheet transfer direction (vertical scan direction) by the vertical scan transfer unit 1003. Alternatively, the image forming unit 1002 may be of the line type equipped with a line head.

To the line of nozzles on the recording head 1024 for discharging droplets of black (Bk) ink, cyan(C) ink, magenta (M) ink, and yellow (Y) ink, ink of each color is supplied from a sub-tank 1025 mounted on the carriage 1023. The sub-tank 1025 is replenished with ink from an ink cartridge 1026 for each color, which is a main tank detachably attached in the apparatus body 1001, via tubing (not shown).

The vertical scan transfer unit 1003 includes an endless transfer belt 1031 extended between a transfer roller 1032, which is a drive roller, and a driven roller 1033, for changing the direction of transfer of the sheet 1005 as it is fed from below by substantially 90° toward the image forming unit 1002; a charge roller 1034 to which an AC bias is applied for charging the surface of the transfer belt 1031; a guide member 1035 for guiding the transfer belt 1031 in an area opposite the image forming unit 1002; a holddown roller (pressure roller) 1036 for holding down the sheet 1005 onto the transfer belt 1031 at a position opposite the transfer roller 1032; and a transfer roller 1037 for sending the sheet 1005 on which an image has been formed by the image forming unit 1002 onto an ejected paper transfer unit 1006.

The transfer belt 1031 of the vertical scan transfer unit 1003 rotates in the vertical scan direction as the transfer roller 1032 is rotated by a vertical scan motor 1131 via a timing belt 1132 and a timing roller 1133.

The sheet feeding unit 1004 includes a sheet-feeding cassette 1041 that can be inserted and removed from the apparatus body 1001, for storing a number of sheets 1005; a sheet-feeding roller 1042 and a friction pad 1043 for feeding the sheets 1005 from the sheet-feeding cassette 1041 one sheet at a time; and a sheet-feeding transfer roller 1044 which is a resist roller for transporting the sheet 1005 to the vertical scan transfer unit 1003. The sheet-feeding roller 1042 is rotated by a sheet-feeding motor 1141, which may be a hybrid (HB) stepping motor, via a sheet-feeding clutch (not shown). The sheet-feeding transfer roller 1044 is also rotated by the sheet-feeding motor 1141.

The ejected paper transfer unit 1006 includes ejected paper transfer roller pairs 1061 and 1062 for transporting the sheet 1005 on which an image has been formed; and ejected paper transfer roller pairs 1063 and 1064 for sending the sheet 1005 out to the ejected paper tray 1007.

Figure 11:
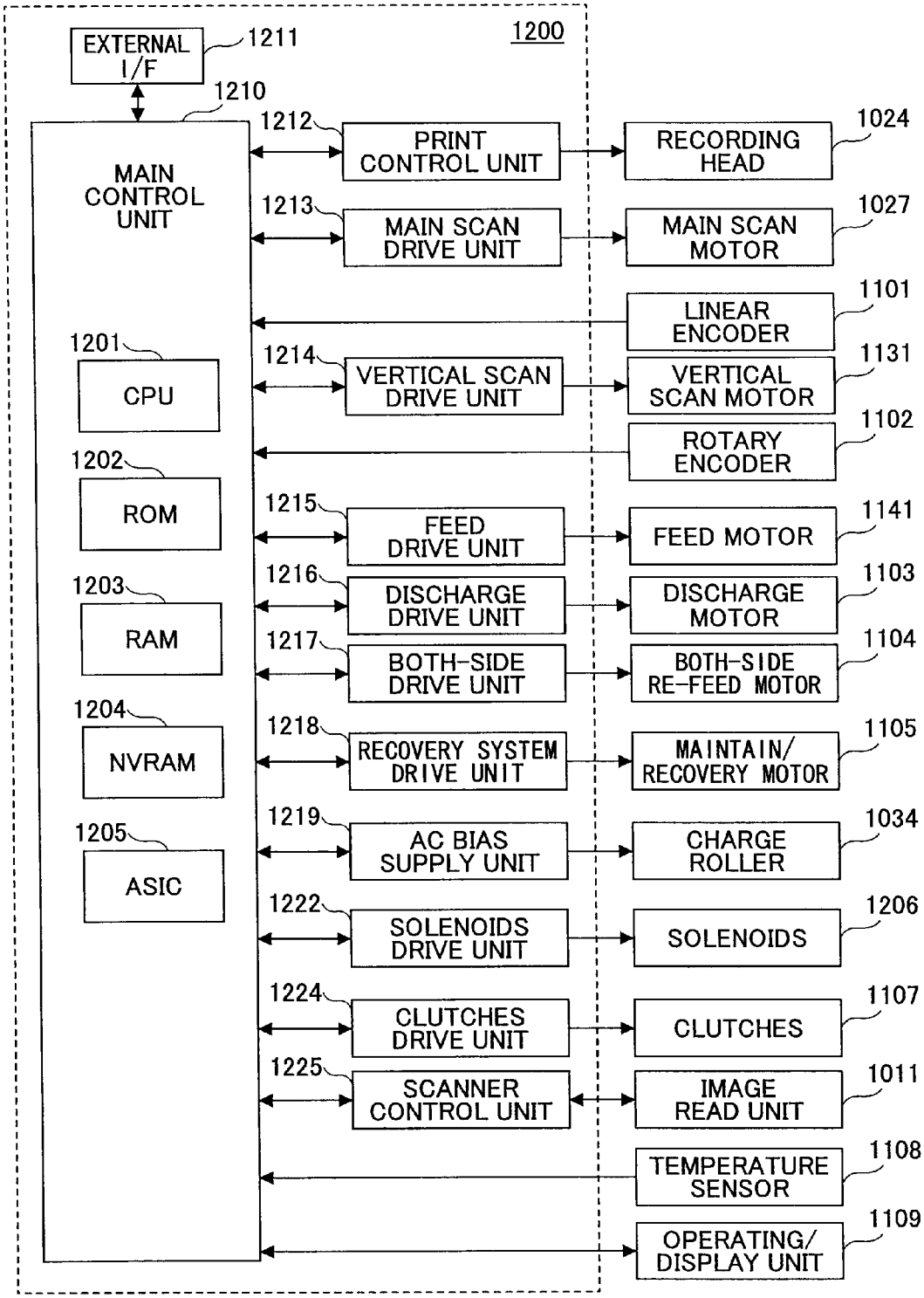
FIG. 11 shows a block diagram of a control unit of the image forming apparatus.

In the following, a control unit 1200 of the image forming apparatus is described with reference to a block diagram shown in FIG. 11.

The control unit 1200 includes a main control unit 1210 for controlling the apparatus as a whole. The main control unit 1210 includes a CPU 1201; a ROM 1202 for storing a program executed by the CPU 1201 and other fixed data; a RAM 1203 for temporary storage of image data or the like; a non-volatile memory (NVRAM) 1204 for retaining data while power to the apparatus is turned off; and an ASIC 1205 for performing image processing on an input image, such as halftone processing.

The control unit 1200 also includes an external I/F 1211 disposed between a host, such as an information processing apparatus functioning as an image processing apparatus, and the main control unit 1210, in order to process the transmission and reception of data and signals; a print control unit 1212 that includes a head driver for driving and controlling the recording head 1024; a horizontal scan drive unit (motor driver) 1213 for driving the horizontal scan motor 1027 by which the carriage 1023 is moved; a vertical scan drive unit 1214 for driving the vertical scan motor 1131; a sheet-feeding drive unit 1215 for driving the sheet-feeding motor 1141; a paper ejection drive unit 1216 for driving the paper ejection motor 1103 by which each roller in the paper ejection unit 1006 is driven; a both-side drive unit 1217 for driving a both-side refeeding motor 1104 by which each roller of a both-side unit (not shown) is driven; a recovery system drive unit 1218 for driving a maintain/recover motor 1105 by which the maintain/recover mechanism is driven; and an AC bias supply unit 1219 for supplying AC bias to the charge roller 1034.

The control unit 1200 further includes a solenoids drive unit (driver) 1222 for driving various types of solenoids (SOL) 1106; a clutch drive unit 1224 for driving electromagnetic clutches 1107 as they relate to feeding of sheets; and a scanner control unit 1225 for controlling the image reading unit 1011.

To the main control unit 1210, a detection signal from a temperature sensor 1108 for detecting the temperature of the transfer belt 1031 is inputted. Though not shown, detection signals from various other sensors may also be inputted to the main control unit 1210. The main control unit 1210 is also connected with an operating/display unit 1109 in order to receive necessary key inputs and output display information. The operation/display unit 1109 may include various keys such as a numerical keypad and a print start key and various indicators, which may be provided on the apparatus body 1001.

The main control unit 1210 is also fed with an output signal (pulse) from a linear encoder 1101, which detects the speed and the amount of movement of the carriage 1023, and an output signal (pulse) from a rotary encoder 1102 for detecting the speed and the amount of movement of the transfer belt 1031. Based on these output signals and their correlation, the main control unit 1210 drives and controls the horizontal scan motor 1027 and the vertical scan motor 1131 via the horizontal scan drive unit 1213 and the vertical scan drive unit 1214, respectively, thereby moving the carriage 1023 and causing the transfer belt 1031 to move to transport the sheet 1005.

An image formation operation in the thus constructed image forming apparatus is briefly described. As the AC bias supply unit 1219 applies a rectangular-wave high voltage alternating between positive and negative poles to the charge roller 1034, which is in contact with an insulated layer (surface layer) of the transfer belt 1031, the surface layer of the transfer belt 1031 is charged with alternating bands of positive and negative charges in the transport direction of the transfer belt 1031. Thus, the surface of the transfer belt 1031 is charged with predetermined charge widths, thereby producing a non-uniform electric field.

Then, the sheet 1005 is fed from the sheet feeding unit 1004 onto the transfer belt 1031 between the transfer roller 1032 and the holddown roller 1036. There, because the non-uniform electric field is present due to the formation of the positive- and negative-pole charges, the sheet 1005 is instantaneously polarized in accordance with the direction of the electric field. As a result, the sheet 1005 is adsorbed on the transfer belt 1031 by the electrostatic force, and transported as the transfer belt 1031 moves.

As the sheet 1005 is intermittently transported on the transfer belt 1031, droplets of recording fluid is discharged onto the sheet 1005 by the recording head 1024 in accordance with print data, whereby an image is formed (printed). Thereafter, the tip of the image-formed sheet 1005 is separated from the transfer belt 1031 by the separating nail, and the sheet 1005 is ejected onto the ejected paper tray 1007 by the ejected paper transfer unit 1006.

In accordance with an embodiment of the present invention, it is also possible to print a print medium such that no margin is provided in at least one of the edges. In this case, ink is inevitably discharged outside the print medium when printing an edge portion. This is due to the fact that even if ink is ejected in such a manner as to print just up to the edge of the print medium, the ink in reality often fails to land on an ideal landing position because of errors, such as feed error in the print medium transfer system or a drive error in the carriage, resulting in the creation of a margin. Consequently, it is necessary to print an area larger than is ideal, taking into consideration the print position errors, thereby resulting in the discharge of ink outside the print medium. The ink that misses the print medium does not contribute to recording and is therefore a waste of ink. In order to reduce such a waste ink as much as possible, a method is known whereby the transfer accuracy of the print medium is enhanced so that, by reducing the expected area in which the waste ink lands, the waste ink is reduced. For example, transfer accuracy may be improved by reducing the rate of feed of the print medium when printing its edge portion.

When an expendable supply such as ink, a recording medium, or a recording head that is not a specific product, such as a recommended product, is used, problems such as beading and other various image quality degradations tend to occur because of inability to discharge an ink droplet normally or the difference in ink absorbing properties among different recording media, for example. Thus, users are encouraged to use specific expendable supplies, such as ones recommended by the manufacturer.

Therefore, in an embodiment of the invention, upon detection of ink, a recording medium, or a recording head that is not a specific item, the user is notified that the currently selected expendable supply is not a specific item, and informed that switching to a specific expendable supply will result in better image quality. As long as the user switches to a suggested specific expendable supply, the user can be provided with a high quality image.

Even when a specific expendable supply is not used, a stable quality image may be provided to a user by changing the image forming method, such as by selecting a more stable ink-droplet discharge method, or by adjusting the amount of droplet that becomes attached to the recording medium.

In order to enable such a change of the method, the recording apparatus may be equipped with a dedicated mode for the case where a specific expendable supply is not used. Alternatively, it is also possible to accommodate such a change by modifying part of a standard image forming method (as will be described in detail later with reference to FIG. 33). By thus allowing a user to select an appropriate output method, an output image that is more in line with the user's preferences can be provided.

Whether the expendable supply is a specific expendable supply or not may be detected either automatically by the system or based on a user's manual input.

In a method of automatically detecting ink that is not a specific product, the use period of an ink cartridge may be acquired from an IC chip attached to the cartridge.

If the use period is excessively long, it is possible that the user has refilled the ink cartridge by himself. Alternatively, information about the accumulated amount of ink that has been used may be acquired from an IC chip attached to the cartridge. If the accumulated amount of ink used is greater than the original amount of ink in the ink cartridge, it is possible that the user has refilled the ink cartridge with ink by himself. In these cases, the use of a non-specific product can be detected.

In a method of automatically detecting a recording head that is not a specific product, a unique ID of the recording head may be acquired from an IC chip attached to the recording head.

In this case, a unique ID may be stored in the IC chip by a manufacturer upon shipping of the recording head. A recording apparatus acquires the unique ID at the start of recording, and determines whether the acquired ID corresponds to the manufacturer's designated ID. If not, the recording head can be detected as a non-specific product.

In a method of automatically detecting a recording medium that is not a specific products, the thickness or the basis weight of the recording medium may be acquired.

For example, a sensor may be provided in a transfer passage in a recording apparatus, in order to measure the thickness or the basis weight of a recording medium at the start of recording. If the obtained values are outside a specific range, which may be designated by the recording apparatus manufacturer, the recording medium can be detected as a non-specific product. For example, the thickness may be set in the range of from 90 to 110 μm, and the basis weight may be set in the range of between 50 to 250 g/m$^2$, although the present invention is not limited by such ranges.

By thus providing an automatic detection mechanism, it becomes possible to automatically provide a stable quality image to a user.

In the case of a user's manual input, a switch or the like may be mounted on the exterior of the recording apparatus so that whether ink, a recording medium, and/or a recording head are specific products can be selected. In this way, a user can indicate whether any of the above items is a specific item. Alternatively, a check box or radio buttons may be provided in a print setting screen in a window of a PC or on a display unit of the recording apparatus, in order for the user to enter information indicating whether a certain element is a specific product or not. In this way, a user can confirm whether a certain item is a specific expendable supply.

By thus providing a manual-input detecting mechanism, it becomes possible to provide a stable-quality image to the user without providing the aforementioned automatic detecting mechanism.

In the following, the change of the image forming method in a case where a specific expendable supply is not used is described.

Based on similarity in various means to obtain a high-quality image, the following four aspects are described in order.

Improvement of landing position error (to prevent nonuniformity)

Adjustment of attached ink amount (to prevent beading, cockeling, or transfer)

Improvement of hue error (to achieve a certain specific hue)

Ensuring ink drying time (to prevent beading, cockeling, or transfer)

Of those four items, the initial three items relate to the change of the image forming method; the other one relates to a change in another operation.

Improvement of Landing Position Error

Figure 12A:
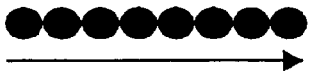
FIG. 12A illustrates a sequence of dots according to original digital data.
Figure 12B:
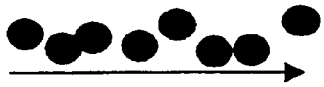
FIG. 12B illustrates a sequence of dots that are actually printed using a system that is other than a specific system.

In an actual image forming apparatus, a landing position error may be caused by various factors, resulting in image quality degradation. One of such factors is the discrepancy between the period of fluctuation of the meniscus and the print clock (i.e., the discharge timing). Specifically, if the meniscus is not stabilized within the duration between the discharge of an ink droplet and the discharge of the next ink droplet, a landing position error may occur due to abnormal discharge (see FIG. 12B).

Figure 13A:
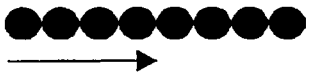
FIG. 13A illustrates a sequence of dots according to original digital data.
Figure 13B:
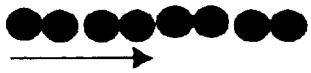
FIG. 13B illustrates a sequence of dots that are actually printed by lowering the speed of movement of the carriage below normal.

In accordance with an embodiment of the present invention, the time for the meniscus to stabilize is ensured by reducing the speed of movement of the carriage. For example, by decreasing the speed of movement of the carriage below normal, a longer time can be provided between one discharge and the next, so that the meniscus can be stabilized in time. Thus, the landing position error can be reduced, and a high-quality image can be obtained (see FIG. 13B).

Figure 14A:
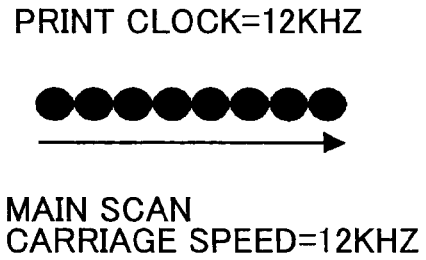
FIG. 14A illustrates a sequence of dots according to original digital data.
Figure 14B:
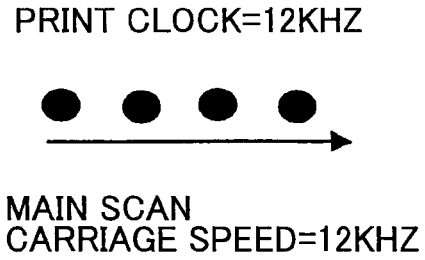
FIG. 14B illustrates a sequence of dots that are actually printed after a first pass.
Figure 14C:
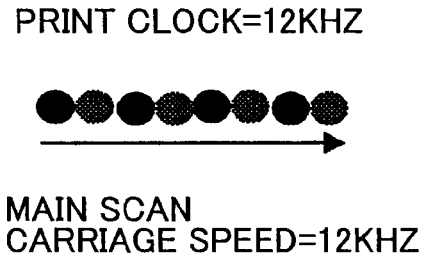
FIG. 14C illustrates a sequence of dots that are actually printed after a second pass.

The meniscus can also be stabilized by increasing the number of passes above normal. Specifically, as shown in FIGS. 14B and 14C, by forming an image over plural passes, the intervals of time at which droplets are discharged successively in one scan can be extended, so that the meniscus can be stabilized. While the number of passes in the example of FIGS. 14B and 14C is two, this is merely an example and the number may be greater than two.

Nonuniformity can also be reduced by not using droplets with a large landing position error. For example, a large droplet (i.e., a droplet corresponding to a large dot size) and a small droplet (i.e., a droplet corresponding to a small dot size) have different energies required for discharge and also different weights.

Figure 15A:
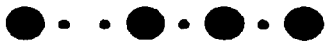
FIG. 15A illustrates a sequence of dots according to original digital data.
Figure 15B:
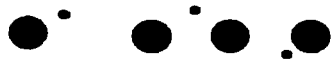
FIG. 15B illustrates a sequence of dots that are actually printed using a system other than a specific system.
Figure 16A:
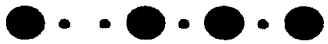
FIG. 16A illustrates a sequence of dots according to original digital data.
Figure 16B:
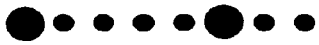
FIG. 16B illustrates a sequence of dots that are actually printed by eliminating the use of small droplets.

In the case of a small droplet, because it can be discharged with a very small energy, it is possible that a discharge cannot be performed in the absence of meniscus stability. Also, because its weight is small, the small droplet may become scattered and tend to land at an unintended position (see FIG. 15B). Thus, by forming an image in which gradation process is optimized with large or intermediate droplets, which have higher landing position accuracy, while avoiding small droplets, a high-quality image can be obtained (see FIG. 16B). When it is expected that the large and small droplets have low discharge stability, an image may be formed with intermediate droplets alone, thus suppressing the discharge of more than one kind of droplet.

Figure 17A:
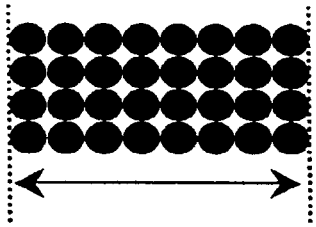
FIG. 17A illustrates a sequence of dots according to original digital data.
Figure 17B:
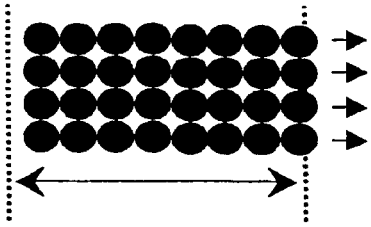
FIG. 17B illustrates a sequence of dots that are actually printed when printing the digital data in one direction.
Figure 17C:
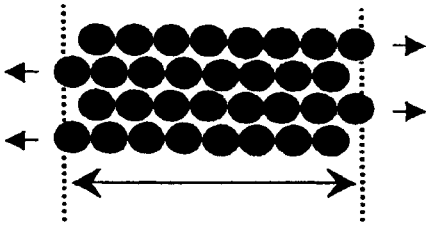
FIG. 17C illustrates a sequence of dots that are actually printed when printing the digital data in two directions.

Nonuniformity can also be reduced by switching from a bidirectional printing to a one-directional printing. For example, when the thickness of a recording medium differs from a recommended value, or when the manner in which energy is applied to a droplet differs from a recommended manner, a landing position error may occur in the horizontal scan direction (see FIG. 17B). In this case, if a bidirectional printing is carried out, the printed position may differ between the forward direction and the backward direction, resulting in an image quality degradation such as nonuniformity (see FIG. 17C). Such a nonuniformity in the image may be reduced and a high-quality image may be obtained by recording only in the forward direction. Simultaneously, this may eliminate the color difference between a dot printed in the forward direction and a dot printed in the backward direction in the case of bidirectional printing. Further, the one-directional printing makes it easier to reduce beading because of the time required for the carriage to return to the print start position. The effect of a landing position error can also be made less visible by reducing the number of lines in half-tones.

Figure 18A:
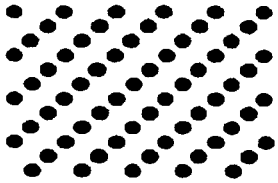
FIG. 18A illustrates a line screen according to original digital data in the case of a high line number.
Figure 18B:
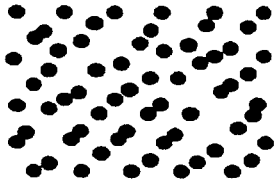
FIG. 18B illustrates a line screen that is actually printed from the digital data of FIG. 1BA.
Figure 18C:
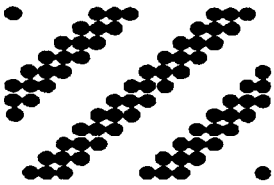
FIG. 18C illustrates a line screen according to original digital data in the case of a low line number.
Figure 18D:
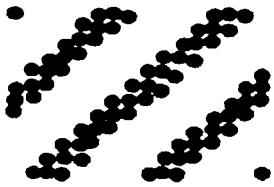
FIG. 18D illustrates a line screen that is actually printed from the digital data of FIG. 18C.
Figure 19A:
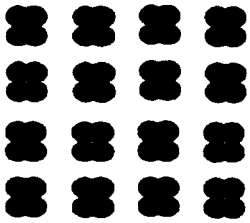
FIG. 19A illustrates halftone dots according to original digital data in the case of a high line number.
Figure 19B:
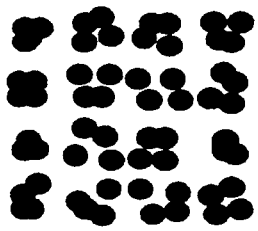
FIG. 19B illustrates halftone dots that are actually printed from the digital data of FIG. 19A.
Figure 19C:
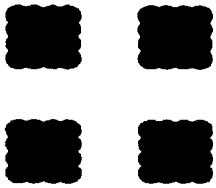
FIG. 19C illustrates halftone dots according to original digital data in the case of a low line number.
Figure 19D:
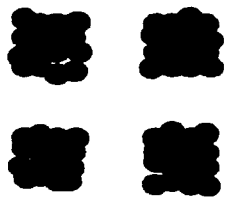
FIG. 19D illustrates halftone dots that are actually printed from the digital data of FIG. 19C.

FIG. 18B and FIG. 19B show actual printed images in the case of a high line number. While the original digital data should appear as a basic tone shown in FIG. 18A or FIG. 19A, the basic tone appear weakened in FIG. 18B and FIG. 19B, due to the influence of a landing position error. By reducing the number of lines, the basic tone can be made to appear more clearly, as shown in FIG. 18D and FIG. 19D. In this way, the influence of a landing position error can be made less visible. When a borderless print is performed, discharge of ink onto areas outside the recording medium is undesirable. In this case, because it is difficult to support the sheet, image quality degradation is likely to occur. Thus, the landing position accuracy needs to be increased near the edges, and some measure needs to be taken to improve image quality. For this reason, a process is preferably carried out to achieve higher image quality when performing borderless print.

Adjustment of Attached Ink Amount

When an ink or a sheet other than a specific product, such as a manufacturer's recommended product, is used, because the amount of ink that can be absorbed differs from one type of sheet to another, an excessive amount of ink may become attached, resulting in image quality degradation such as beading, cockeling, or transfer. Thus, the attached ink amount in this case needs to be limited. This can be realized by reducing the amount of ink that becomes attached per unit area below normal when recording.

Improvement of Hue Error

When an ink or a sheet other than a specific product is used, the probability is high that the ink has a hue that differs from the hue of the specific product. In this case, when the color of black or gray is produced by combining black ink and color ink, it may become impossible to maintain a specific gray balance. In order to maintain a specific gray balance, either black ink alone or composite black in which very small amounts of color ink are used may be used (i.e., the types of ink used are limited). Recently, image forming apparatuses are available in which light color inks, such as light magenta or light cyan, are adopted. In the case of these apparatuses, a recommended gray balance may be better maintained by using inks with smaller chroma values in combination while avoiding the use of inks with relatively large chroma values, such as cyan, magenta, or yellow, whenever possible.

Ensuring Ink Drying Time

When an ink or a sheet other than a specific product is used, because the amount of ink absorbed differs from one type of sheet to another, an excess amount of ink may become attached, resulting in the ink requiring a long time to dry. In such a case, if high-speed printing is performed, large amounts of ink may remain undried on the sheet surface, possibly resulting in image quality degradation such as beading or cockeling. Such an image quality degradation can be reduced by making the period between the end of one scan in the horizontal scan direction and the start of the next scan longer than normal. For example, the standby time at the home position or the print start position before the next scan is initiated may be extended.

The need for an extended period of time before the ink dries may also lead to the ink remaining undried even in the ejected paper tray after the sheet is ejected. In this case, if continuous printing is performed, there is the danger that, as a second printed sheet is laid over a first printed sheet in the ejected paper tray, the printed surface of the first sheet may be scratched, or the back surface of the second sheet may be soiled. Such an image quality degradation in the first and/or the second sheets can be prevented by making the time between the end of printing the recording medium and its ejection longer than normal.

In the case of a both-side printing, typically the recording medium is printed on its first surface and then transferred back to have its second surface printed. In this case, if an ink or a sheet other than a recommended product is used, because the amount of ink absorbed differs from one type of sheet to another, an excessive amount of ink may become attached, possibly resulting in the ink on the first surface attaching to the sheet transfer mechanism. If that happens, image quality suffers not only on the first surface but also the second surface. Such an image quality degradation on the first surface and the second surface can be prevented by making the time between the end of printing of the first surface and the start of printing of the second surface longer than normal.

The aforementioned processes for changing the image forming method may be performed using the aforementioned program executed by the image forming apparatus described with reference to FIGS. 1 through 10. The program is therefore an embodiment of the present invention. The program, which may be stored as part of the printer driver in the ROM 202 shown in the block diagram of FIG. 5, may be started up by an operator operation and expanded on the RAM 203, followed by execution by the CPU 201. The printer driver including the program may be downloaded to the image forming apparatus from a storage unit on a network. Alternatively, the program may be installed on the image forming apparatus via a computer-readable recording medium such as a compact disc.

Examples of the aforementioned computer-readable recording medium include semiconductor media (such as a ROM or a nonvolatile memory card); optical media (such as a digital versatile disc (DVD), a magnetooptical disc (MO), a MiniDisc (MD), and a Compact Disc Recordable (CD-R)); and magnetic media (such as magnetic tape or a flexible disc). Based on an instruction from the program that is loaded, part or all of the actual processes may be carried out by the operating system in order to realize the functions of the present embodiment. When the program is stored in a storage unit such as a hard disk drive in a server computer, and downloaded via a user's computer connected to a network for distribution, or when the program is distributed from a server computer, the storage unit of the server computer is included in the computer-readable recording medium according to the present embodiment of the invention. By thus writing the necessary functions in a program, recording it in a computer-readable recording medium, and then distributing it, improvements in terms of cost reduction, portability, and versatility can be achieved.

Hereafter, an example of a specific recording medium used in the present embodiment of the invention is described.

Media

A recording medium according to the present embodiment comprises a support member and a coating layer on at least one side of the support. The recording medium may also include other layers as needed.

Preferably, the recording medium has an ink transfer amount of 4 to 15 ml/m$^2$ and more preferably 6 to 14 ml/m$^2$ as measured with a dynamic scanning absorptometer at the contact time of 100 ms. The transfer amount of pure water to the recording medium is preferably 4 to 26 ml/m$^2$ and more preferably 8 to 25 ml/m$^2$.

If the transfer amount of ink or pure water at the contact time of 100 ms is too small, beading may become more likely to occur. If the transfer amount is too much, the recorded ink dot size may become smaller than desired.

The transfer amount of ink to the recording medium of the present embodiment as measured with the dynamic scanning absorptometer at the contact time 400 ms is 7 to 20 ml/m$^2$ and preferably 8 to 19 ml/m$^2$. Preferably, the transfer amount of pure water to the recording medium is 5 to 29 ml/m$^2$ and more preferably 10 to 28 ml/m$^2$.

If the transfer amount at the contact time 400 ms is too small, drying property is insufficient and a spur mark may become more likely to occur. If the transfer amount is too much, bleeding tends to occur, and the glossiness at an image portion after drying may become more likely to decrease.

The dynamic scanning absorptometer (DSA) (as described by Shigenori Kuga in Japan TAPPI Journal, Vol. 48, pp. 88-92, May 1994) is an apparatus capable of accurately measuring the amount of liquid absorbed within an extremely short period of time. The dynamic scanning absorptometer is capable of performing automatic measurement using a method whereby the rate of liquid absorption is directly read from the movement of the meniscus in a capillary, a disc-shaped sample is scanned with a liquid absorption head in a helical manner, and the scan speed is automatically changed in accordance with a preset pattern to measure as many points as necessary on a single sample. A head for supplying liquid to a paper sample is connected to a capillary via a Teflon (registered trademark) tube, and the position of the meniscus in the capillary is automatically read by an optical sensor. Specifically, a dynamic scanning absorptometer (K350 Series, Type D, manufactured by Kyowa Co., Ltd.) was used to measure the transfer amount of pure water and ink. The transfer amount at contact times 100 ms and 400 ms can be determined by interpolation of measured values of transfer amounts at contact times around each of these contact times. The measurement was performed at 23° C. and 50% RH.

Support Member

The support member is not particularly limited and may be appropriately selected depending on the purpose. Examples are a sheet of paper mainly made of wood fibers and a sheet of nonwoven fabric mainly made of wood and synthetic fibers.

The aforementioned sheet of paper is not particularly limited and may be appropriately selected depending on the purpose. For example, it may be made of wood pulp or recycled pulp. Examples of wood pulp are leaf bleached kraft pulp (LBKP), needle bleached kraft pulp (NBKP), NBSP, LBSP, GP, and TMP.

As materials of recycled pulp, recycled papers indicated in the list of standard qualities of recycled papers from the Paper Recycling Promotion Center may be used. Examples include high-quality white; white with lines; cream white; cards; special white; medium white; high-quality with ink; white with color ink; Kent; white art; medium-quality chip with color ink; low-quality chip with color ink; newspaper; and magazine. More specific examples are information-related paper such as non-coating computer paper, and printer paper such as thermal paper and impact paper; OA recycled paper such as PPC; coated paper such as art paper, ultra lightweight coated paper, and mat paper; and uncoated paper such as high-quality paper, high-quality paper with color ink, notebooks, letter paper, packaging paper, fancy paper, medium-quality paper, newspaper, coarse paper, high-quality with ink, pure-white roll paper, chemical pulp paper, and high-yield pulp containing paper. These types of paper may be used individually or in combination.

Normally, recycled pulp is made by a combination of the following four steps:

(1) A defibrating step of breaking down used paper into fibers and separating ink from the fibers using mechanical force and chemicals in a pulper.

(2) A dust removing step of removing foreign matter (such as plastic) and dust in the used paper with a screen or a cleaner.

(3) A deinking step of expelling the ink separated by a surfactant from the fibers out of the system by a flotation method or a cleaning method.

(4) A bleaching step of increasing the whiteness of the fibers by oxidization or reduction.

When mixing recycled pulp, the percentage of recycled pulp to the entire pulp is preferably 40% or lower so that produced paper does not curl after recording.

As an internal filler for the support, a conventional white pigment may be used. Examples include inorganic pigments such as precipitated calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithophone, zeolite, magnesium carbonate, and magnesium hydrate; and organic pigments such as styrene plastic pigment, acrylic plastic pigment, polyethylene, microcapsule, urea resin, and melamine resin. The above substances may be used individually or in combination.

As an internal sizing agent used when producing the support, a neutral rosin size agent used for neutral papermaking, alkenyl succinic anhydride (ASA), alkyl ketene dimer (AKD), or a petroleum resin size agent may be used. Especially, a neutral rosin size agent and alkenyl succinic anhydride are preferable. Alkyl ketene dimer has a high sizing effect and therefore does not require a large added amount. However, because alkyl ketene dimer reduces the friction coefficient of the surface of recording paper (medium) and thus makes the paper made slippery, alkyl ketene dimer may not be suitable from the viewpoint of transport during inkjet recording.

Coating Layer

The coating layer contains a pigment and a binder, and may also contain a surfactant and other components as needed.

As the pigment, an inorganic pigment or a mixture of an inorganic pigment and an organic pigment may be used.

Examples of the inorganic pigment include kaolin, talc, heavy calcium carbonate, precipitated calcium carbonate, calcium sulfite, amorphous silica, alumina, titanium white, magnesium carbonate, titanium dioxide, aluminum hydroxide, calcium hydrate, magnesium hydrate, zinc hydroxide, and chlorite. Among those, kaolin is particularly preferable because it has superior glossiness exhibiting property and provides a texture similar to that of an offset paper.

There are several types of kaolin, including delaminated kaolin, calcined kaolin, and engineered kaolin made by surface modification. In consideration of glossiness exhibiting property, 50% by mass or more of the entire kaolin has a particle size distribution such that 80% by mass or greater of the particles has a particle size of 2 μm or smaller.

Preferably, the added amount of kaolin is 50 parts by mass with respect to 100 parts by mass of the entire pigment in the coating layer. If the added amount of kaolin is lower than 50 parts by mass, sufficient glossiness may not be obtained. While there is no specific upper limit to the amount of kaolin added, the added amount of kaolin is preferably 90 parts by mass or smaller from the viewpoint of surface-coating property and in consideration of fluidity of kaolin, particularly the thickening property of kaolin under a high shearing force.

Examples of the organic pigment include a water-soluble dispersion of styrene-acrylic copolymer particles, styrene-butadiene copolymer particles, polystyrene particles, and polyethylene particles. Two or more of the above organic pigments may be used in combination.

Preferably, the added amount of the organic pigment is 2 to 20 parts by mass with respect to 100 parts by mass of the entire pigment in the coating layer. Because the organic pigment has excellent glossiness exhibiting property and a specific gravity smaller than that of an inorganic pigment, it provides a thick, high-gloss coating layer having a good surface-coating property. If the added amount of the organic pigment is less than 2 parts by mass, the aforementioned effect may not be obtained. If it exceeds 20 parts by mass, the fluidity of a coating liquid may worsen, resulting in a decrease in coating process efficiency and a cost disadvantage.

The organic pigments may be classified by their particle shapes into the solid-type, the hollow-type, and the doughnut-shape type. To achieve a good balance among glossiness, surface-coating property, and fluidity of coating liquid, preferably the organic pigment has an average particle size of 0.2 to 3.0 μm. More preferably, the organic pigment is of the hollow-type with a void percentage of 40 percent or greater.

As the binder, a water-based resin is preferably used.

As the water-based resin, either a water-soluble resin or a water-dispersible resin may be suitably used. The water-soluble resin is not particularly limited and may be selected depending on the purpose. Examples are polyvinyl alcohol; a modified polyvinyl alcohol such as anion-modified polyvinyl alcohol, cation-modified polyvinyl alcohol, and acetal-modified polyvinyl alcohol; polyurethane; polyvinyl pyrrolidone; modified polyvinyl pyrrolidone such as polyvinyl pyrrolidone-vinyl acetate copolymer, vinyl pyrrolidone-dimethylaminoethyl methacrylate copolymer, quaternized vinyl pyrrolidone-dimethylaminoethyl methacrylate copolymer, and vinyl pyrrolidone-methacrylamide propyl trimethyl ammonium chloride copolymer; cellulose such as carboxymethyl cellulose, hydroxyethyl cellulose, and hydroxypropylcellulose; modified cellulose such as cationized hydroxyethyl cellulose; polyester, polyacrylic acid (ester), melamine resin, and their modified products; synthetic resin made of polyester-polyeurethane copolymer; and other substances such as poly(metha)acrylic acid, poly(metha)acrylamide, oxidized starch, phosphorylated starch, self-denatured starch, cationized starch, other modified starches, polyethylene oxide, polyacrylic acid soda, and alginic acid soda. The above substances may be used individually or in combination.

Among the above substances, polyvinyl alcohol, cation-modified polyvinyl alcohol, acetal-modified polyvinyl alcohol, polyester, polyurethane, and polyester-polyeurethane copolymer are especially preferable in terms of ink absorbing property.

The water-dispersible resin is not particularly limited and may be selected appropriately depending on the purpose. Examples are polyvinyl acetate, ethylene-polyvinyl acetate copolymer, polystyrene, styrene-(metha)acrylic ester copolymer, (metha)acrylic ester polymer, polyvinyl acetate-(metha) acrylic acid(ester)copolymer, styrene-butadiene copolymer, ethylene-propylene copolymer, polyvinyl ether, and silicone-acrylic copolymer. The water-dispersible resin may contain a cross-linking agent such as methylol melamine, methylol urea, methylol hydroxypropylene urea, or isocyanate. The water-dispersible resin may be a self-crosslinking copolymer containing a unit of N-methylol acrylamide. Two or more of such water-dispersible resins described above may be used at the same time.

The added amount of the water-based resin is preferably 2 to 100 parts by mass and more preferably 3 to 50 parts by mass to 100 parts by mass of the pigment. The added amount of the water-based resin is determined so that the liquid absorption property of a recording medium falls within a desired range.

When a water-dispersible colorant is used as the coloring agent, the mixing of a cationic organic compound is optional, and an appropriate cationic organic compound may be selected and used depending on the purpose. Examples include primary to tertiary amines that react with sulfonic groups, carboxyl groups, or amino groups in a direct dye or an acid dye in a water-soluble ink to form insoluble salt; and a monomer, oligomer, or polymer of quarternary ammonium salt. Among these, an oligomer and a polymer are especially preferable.

Examples of the cationic organic compound include dimethylamine-epichlorohydrin polycondensate, dimethylamine-ammonia-epichlorohydrin condensate, poly(trimethyl aminoethyl-methacrylate methylsulfate), diallylamine hydrochloride-acrylamide copolymer, poly(diallylamine hydrochloride-sulfur dioxide), polyallylamine hydrochlorid, poly(allylamine hydrochlorid-diallylamine hydrochloride), acrylamide-diallylamine copolymer, polyvinylamine copolymer, dicyandiamide, dicyandiamide-ammonium chloride-urea-formaldehyde condensate, polyalkylene polyamine-dicyandiamide ammonium salt condensate, dimethyl diallyl ammonium chloride, poly(diallylmethylamine) hydrochloride, poly(diallyldimethylammoniumchloride), poly(diallyldimethylammonium chloride-sulfur dioxide), poly(diallyldimethylammonium chloride-diallyl amine hydrochloride derivative), acrylamide-diallyldimethylammonium chloride copolymer, acrylate-acrylamide-diallyl amine hydrochloride copolymer, polyethylenimine, ethylenimine derivative such as acrylamine polymer, and modified polyethylenimine alkylene oxide. The above substances may be used individually or in combination.

Among those mentioned above, it is preferable to use a cationic organic compound with a low-molecular weight, such as dimethylamine-epichlorohydrin polycondensate or polyallylamine hydrochloride in combination with a cationic organic compound with a relatively-high molecular weight, such as poly(diallyldimethylammonium chloride). Such a combination improves image density and reduces feathering compared with a case where only one substance is used.

The equivalent weight of cation in the cationic organic compound as measured by the colloid titration method (performed using polyvinyl potassium sulfate and toluidine blue) is preferably 3 to 8 meq/g. With the equivalent weight of cation in this range, good results can be obtained within the aforementioned range of dry deposit amount.

In the measurement of the equivalent weight of cation with the aforementioned colloid titration method, the cationic organic compound is diluted with distillated water so that the solid content in the solution becomes 0.1% by mass. No pH control is performed.

The dry deposit amount of the cationic organic compound is preferably between 0.3 and 2.0 g/m$^2$. If the dry deposit amount of the cationic organic compound is smaller than 0.3 g/m$^2$, sufficient improvement in image density may not be obtained or reduction in feathering may not be achieved.

The surfactant is not particularly limited and may be appropriately selected depending on the purpose. Either an anion surfactant, a cation surfactant, an amphoteric surfactant, or a nonionic surfactant may be used. Among the above surfactants, a nonionic surfactant is particularly preferable. Adding a surfactant improves water resistance of an image and increases image density, and also reduces bleeding.

Examples of the nonionic surfactants include higher alcohol ethylene oxide adduct, alkylphenol ethylene oxide adduct, fatty acid ethylene oxide adduct, polyhydric alcohol fatty acid ester ethylene oxide adduct, higher aliphatic amine ethylene oxide adduct, fatty acid amide ethylene oxide adduct, fatty oil ethylene oxide adduct, polypropylene glycol ethylene oxide adduct, glycerol fatty acid ester, pentaerythritol fatty acid ester, sorbitol-sorbitan fatty acid ester, sucrose fatty acid ester, polyhydric alcohol alkyl ether, and alkanolamine fatty acid amide. The above substances may be used individually or in combination.

The polyhydric alcohol is not particularly limited and may be appropriately selected depending on the purpose. Examples are glycerol, trimethylolpropane, pentaerythrite, sorbitol, and sucrose. With reference to an ethylene oxide adduct, part of the ethylene oxide may be substituted with an alkylene oxide such as propylene oxide or butylene oxide to the extent that water solubility is not affected. The substitution ratio is preferably 50 percent or lower. The hydrophile-lipophile balance (HLB) of the nonionic surfactant is preferably between 4 and 15 and more preferably between 7 and 13.

The added amount of the surfactant is preferably 0 to 10 parts by mass and more preferably 0.1 to 1.0 part by mass to 100 parts by mass of the cationic organic compound.

Other components may also be added to the coating layer to the extent that its advantageous effects are not undermined. Examples of such other components include additives such as an alumina powder, a pH adjuster, an antiseptic agent, and an antioxidant.

The method of forming the coating layer is not particularly limited and may be appropriately selected depending on the purpose. One example is a method whereby the support is impregnated or applied with a coating liquid. The method of impregnation or application of the coating layer is not particularly limited and may be selected appropriately depending on the purpose. For example, a coating machine may be used. Examples of the coating machine include a conventional size press, a gate roll size press, a film transfer size press, a blade coater, a rod coater, an air knife coater, and a curtain coater. A preferable example from the viewpoint of cost is a method whereby the support is impregnated or applied with a coating liquid using a conventional size press, a gate roll size press, or a film transfer size press attached to a paper machine so that the process can be finished on-machine.

The amount of the coating liquid on the support is not particularly limited and may be appropriately selected depending on the purpose. Preferably, the solid content of the coating liquid is 0.5 to 20 g/m$^2$ and more preferably 1 to 15 g/m$^2$. If the solid content is less than 0.5 g/m$^2$, the ink cannot be sufficiently absorbed, resulting in an overflow of ink and character bleeding. Conversely, if the solid content exceeds 20 g/m$^2$, the texture of the paper is adversely affected, resulting in problems such as the difficulty in bending of the sheet or writing on it with a writing instrument.

After the impregnation or application of a coating liquid, the coating liquid may be dried as needed. The temperature for this drying process is not particularly limited and may be appropriately selected depending on the purpose. Preferably, the temperature is in the range of from 100 to 250° C.

The recording medium may also have a back layer formed on the back of the support, and other layers between the support and the coating layer or between the support and the back layer. A protective layer may also be provided on the coating layer. Each of these layers may be composed of one or more layers.

The recording medium in accordance with the present embodiment may be commercially available coated paper for offset printing or coated paper for gravure printing, as well as a medium used for ink jet recording, as long as their liquid absorbing property is within the aforementioned range.

Preferably, the basis weight of the recording medium in accordance with the present embodiment is in the range of from 50 to 250 g/m$^2$. If the basis weight is less than 50 g/m$^2$, a transportation defect such as the jamming of the recording medium in the transportation path becomes more likely to occur due to lack of strength. If the basis weight exceeds 250 g/m$^2$, the strength may be too high for the recording medium to turn a curved part of the transportation path, also resulting in a transport defect such as the jamming of the recording medium.

Recording Head

Hereafter, an example of a specific recording head in accordance with the present embodiment is described.

A nozzle plate of the specific recording head is superior in water or ink repellency, so that, even when ink with low surface tension is used, ink droplets (i.e., ink particles) can be formed in a satisfactory manner. This is due to the fact that the nozzle plate is not wetted too much, enabling the normal formation of an ink meniscus. When the meniscus is normally formed, ink does not get pulled in one direction when ejected. As a result, there is less skewing in ink ejection, and an image with high dot-position accuracy can be obtained.

When printing a sheet with low absorbance, the image quality is greatly affected by the dot position accuracy. Namely, because ink does not spread easily on a sheet with low absorbance, even a small amount of decrease in dot position accuracy leads to a portion on the sheet that is not completely filled with ink, i.e., a void. Such an unfilled portion results in image density nonuniformity or image density decrease, thus adversely affecting image quality.

However, because the nozzle plate of the recording head in accordance with the present embodiment can provide high dot position accuracy even when the ink has low surface tension, even a sheet having low absorbance can be filled with ink. As a result, there is no image density nonuniformity or image density decrease, so that printed matter having high image quality can be obtained. Thus, an image forming method according to an embodiment of the present invention needs to be used in the absence of the recording head of the present embodiment.

When ink with a relatively low surface tension is used, the nozzle plate desirably has excellent water repellency and ink repellency. This is due to the fact that by using a nozzle plate having excellent water repellency and ink repellency, it becomes possible to form an ink meniscus normally even when the ink has low surface tension, and, as a result, ink droplets (i.e., ink particles) can be formed in a satisfactory manner. When the meniscus is normally formed, the problem of the ink being pulled in one direction upon ejection can be avoided. As a result, the ink ejection skew can be reduced and an image with high dot position accuracy can be obtained.

When printing a medium (sheet) having low absorbance, the dot position accuracy notably affects image quality. Specifically, because ink does not easily spread over a medium with low absorbance, a portion appears on the medium that is not completely filled with ink, i.e., a void, if dot position accuracy drops even a little. Such an unfilled portion leads to image density nonuniformity and a decrease in image density, thus adversely affecting image quality.

In accordance with the present embodiment, because the inkjet head provides high dot position accuracy even when ink with low surface tension is used, even a medium having low absorbance can be fully filled with ink. Thus, printed matter with high image quality can be obtained having no image density nonuniformity or image density decrease.

Ink-Repellent Layer Material

The material of the ink-repellent layer may comprise any material as long as it repels ink. Examples are fluorine water-repellent material and silicone-based water-repellent material.

There are many types of fluorine water-repellent materials. An example is a mixture of perfluoropolyoxetane and modified perfluoropolyoxetane ("OPTOOL DSX" from Daikin Industries, Ltd.). Necessary water repellency can be obtained by depositing it to a thickness of 1-30 Å. In an experiment, no difference was seen in water repellency and wiping durability when the thickness of OPTOOL DSX was 10, 20, or 30 Å. When factors including cost are taken into account, the thickness is preferably 1 to 20 Å. An adhesive tape made of resin film and applied with adhesive material may be affixed to the surface of a fluorine water-repellent layer to provide an auxiliary function during excimer laser processing. Alternatively, a silicone water-repellent material may be used.

Examples of silicone water-repellent material include room-temperature curing liquid silicone resin and elastomer. Preferably, such a silicone water-repellent material is applied to a base material surface and left to stand in the atmosphere at room temperature in order to allow it to polymerize and cure to form an ink-repellent coating. The silicone water-repellent material may be thermally cured liquid silicone resin or elastomer, which may be applied to a base material surface and heated to cure and form an ink-repellent coating. Further, the silicone water-repellent material may be UV curing liquid silicone resin or elastomer, which may be applied to a base material surface and irradiated with UV ray to cure and form an ink-repellent coating. The viscosity of the silicone water-repellent material is preferably 1,000 cP or lower.

Ink-Repellent Layer

Surface roughness of the ink-repellent layer is described. Preferably, the surface roughness Ra of the ink-repellent layer is 0.2 μm or smaller. By keeping the surface roughness Ra 0.2 μm or smaller, the amount of ink that remains after wiping can be reduced.

Figure 20:
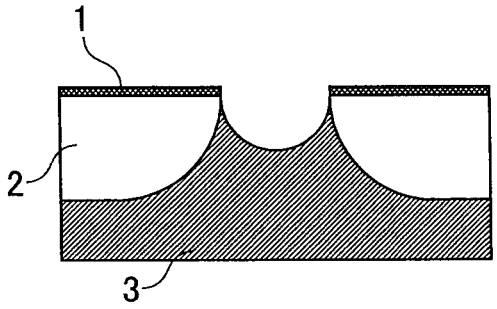
FIG. 20 shows a cross section of an inkjet head nozzle plate according to an embodiment of the present invention.

FIGS. 20 and 21 show cross sections of inkjet head nozzle plates fabricated in accordance with an embodiment. In this embodiment, a nozzle plate 2, which is a base material for an inkjet head, is fabricated by electroforming of Ni. On the surface of the nozzle plate 2, there is formed an ink-repellent film 1, which is a silicone resin coating, having a film thickness of 0.1 μm or greater. The surface roughness Ra of the ink-repellent film 1 is preferably 0.2 or smaller. Preferably, the film thickness of the ink-repellent film 1 is 0.5 μm or greater.

Figure 22A:
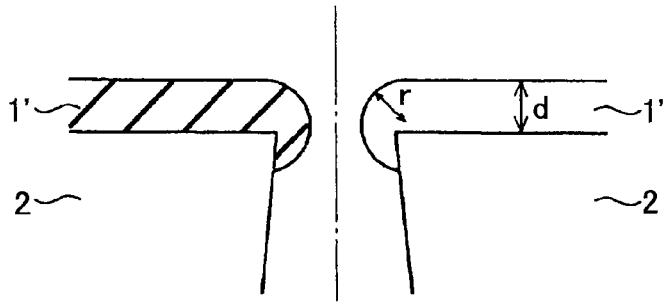
FIG. 22A shows an example of the profile of an opening edge portion of an ink-repellent film where $r<d$.
Figure 22B:
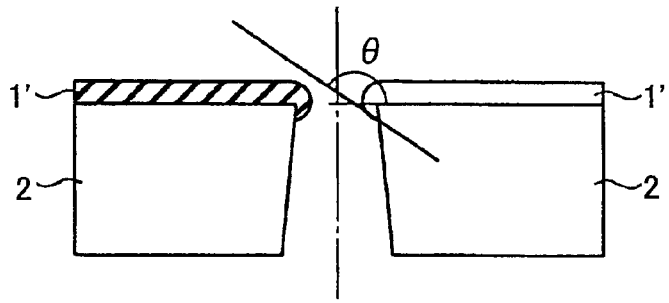
FIG. 22B shows another example of the profile of the opening edge portion of the ink-repellent film where $\theta>90°$.
Figure 22C:
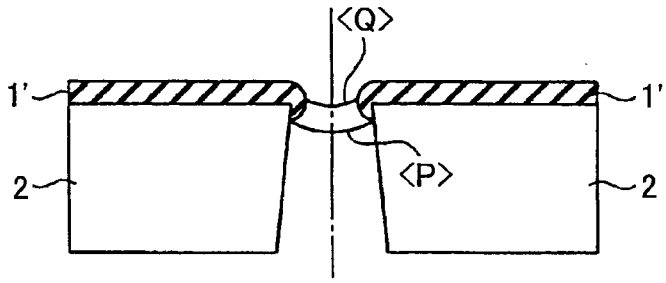
FIG. 22C illustrates two possibilities of the formation of a meniscus at the opening edge.

Upon filling with ink 3, a meniscus (liquid level) P is formed at the boundary between the ink-repellent film 1, i.e., the silicone resin coating, and the nozzle plate 2, as shown in FIG. 22C.

The ink-repellent film 1 is formed such that the cross-sectional area of a plane perpendicular to a center line of the ink discharge opening formed in the inkjet head gradually increases with increasing distance between the plane and the base material surface.

Preferably, the profile of the ink-repellent film 1 near the opening is curved.

Preferably, the radius of curvature of the ink-repellent film near the opening in a cross section taken along a plane including the center line of the opening is greater than the thickness of the ink-repellent film.

Preferably, the curve that extends from the edge of the opening in the ink-repellent film to a region near the opening in the cross section taken along a plane including the center line of the opening is substantially circular-arch shaped. Preferably, the radius of curvature of the arch is greater than the thickness of the ink-repellent film.

Preferably, in the cross section taken along a plane including the center line of the opening, a tangent to the edge of the opening in the ink-repellent film forms an angle of less than 90° with the surface of the nozzle member including the edge.

Figure 21A:
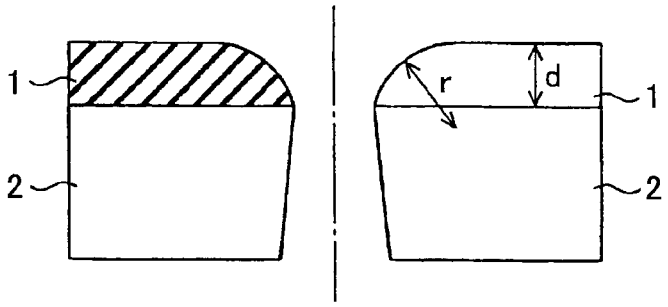
FIG. 21A shows a cross section of an example of an inkjet head nozzle plate.
Figure 21B:
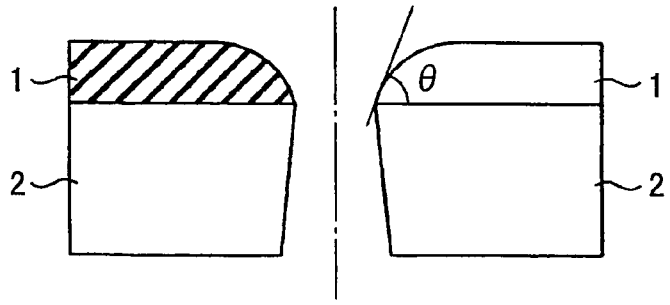
FIG. 21B shows a cross section of another example of an inkjet head nozzle plate.
Figure 21C:
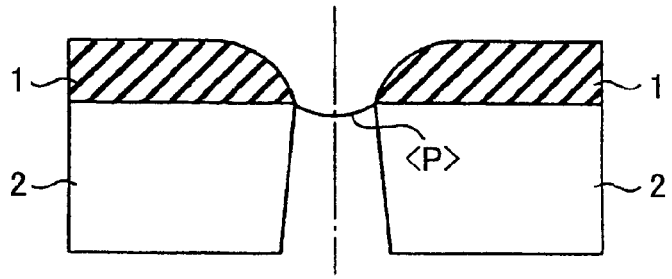
FIG. 21C shows a cross section of yet another example of an inkjet head nozzle plate.

The opening of the nozzle plate 2 is formed in a substantially circular shape about the center line indicated by the dotted line in FIGS. 21A through 21C, in a cross section taken along a plane perpendicular to the center line. The ink-repellent film 1 is formed on the ink discharge surface of the nozzle plate 2 such that the cross-sectional area of the opening in a plane perpendicular to the center line increases with increasing distance from the nozzle plate 2.

More specifically, the opening of the ink-repellent film 1 is, as shown in FIG. 21A, the curve at the opening that extends from the opening edge of the nozzle plate 2 to a portion near the opening has a radius of curvature r. Preferably, the radius of curvature r is greater than the thickness d of the ink-repellent film 1 at a portion other than the opening portion.

The thickness d is a thickness of the ink-repellent film 1 at a portion other than its rounded portion at the opening. Preferably, the thickness d may be the maximum thickness of the ink-repellent film.

Thus, the opening portion of the ink-repellent film 1 adjacent to the opening of the nozzle plate 2 is smoothly curved and has substantially no peaks or pointed portions. In this way, when the nozzle is wiped with a wiper made of material such as rubber, because there is no pointed portions that could catch the wiper, the ink-repellent film 1 is prevented from being peeled from the nozzle plate 2.

Preferably, as shown in FIG. 21B, the tangent to the edge of the opening of the ink-repellent film 1 in the cross section taken along a plane including the center line of the opening of the nozzle plate 2 forms an angle θ of less than 90° with the surface of the nozzle plate 2 including its edge adjacent to the opening of the ink-repellent film 1.

Thus, because the angle θ between the tangent to the opening edge of the ink-repellent film 1 and the surface of the nozzle plate 2 is less than 90°, the meniscus (liquid level) P is stably formed at the boundary between the ink-repellent film 1 and the nozzle plate 2, as shown in FIG. 21C. In this way, the probability of the meniscus P being formed at a different portion can be greatly reduced.

The stable formation of the meniscus enables the ink to be ejected stably when forming an image with an image forming apparatus in which an inkjet head including the nozzle plate 2 is used.

Preferably, a silicone resin that cures at room temperature, particularly one involving hydrolysis reaction, is used.

In the following example, SR2411 manufactured by Dow Corning Toray Co. Ltd. was used.

Table 1 shows the result of evaluation of various properties of the ink-repellent film 1 in the inkjet head, including the profile at the edge of the opening of the nozzle plate 2, the build-up of ink around the nozzle, edge peeling, and ejection stability.

TABLE 1

| Edge shape | | Ink buildup | Edge peeling | Ejection stability |
|---|---|---|---|---|
| Pointed | | Partially | Present | Good |
| Not | $\theta \leqq 90°$ | None | None | Good |
| pointed | $\theta > 90°$ | None | None | Poor |
| (rounded) | $r \geqq d$ | None | None | Good |
| | $r < d$ | None | Partially | Poor |

When the edge of the ink-repellent film 1 (at or near the opening edge) had a substantially pointed portion, a buildup of ink was observed around the nozzle, and edge peeling due to wiping occurred.

When the edge was rounded, no buildup of ink was observed in any of the examples. However, partial peeling of the edge occurred in a comparative example shown in FIG. 22A where r<d. When θ>90° as shown in FIG. 22B, the ejection of droplet was unstable.

An analysis indicates that, as shown in FIG. 22C, when r<d or θ>90°, a meniscus (liquid level) P may be formed at the boundary between the ink-repellent film 1 and the nozzle plate 2 when filled with ink 3, or a meniscus Q may be formed at the bulging portion of the ink-repellent film 1' that extends toward the center of the opening (where the cross-sectional area perpendicular to the center line of the opening is minimum). As a result, fluctuations are caused in ink ejection stability when forming an image in an image forming apparatus using an inkjet head having such a nozzle plate 2.

Hereafter, a process of manufacturing the inkjet head nozzle member according to an embodiment is described.

Figure 23:
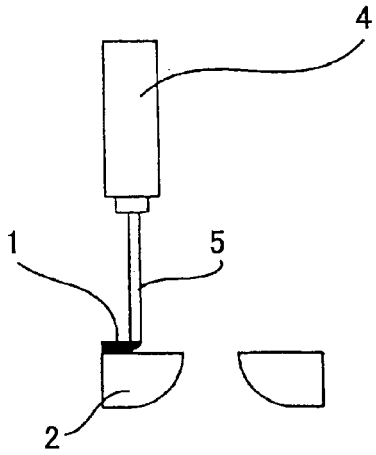
FIG. 23 illustrates an example of how silicone resin is applied to form an ink-repellent film.

FIG. 23 shows the ink-repellent film 1 being formed by applying silicone resin with a dispenser 4 according to the present embodiment.

The dispenser 4 for applying silicone solution is disposed on the ink-discharge side of a nozzle 2, which is made by Ni electroforming. With a predetermined distance maintained between the nozzle plate 2 and the tip of a needle 5, the dispenser 4 is moved while the silicone is discharged from the tip of the needle 5. In this way, a silicone resin coating was selectively formed on the ink discharge surface of the nozzle plate 2, as shown in FIG. 20 and FIGS. 21A through 21C. The silicone resin used in the present example was the room-temperature-curing silicone resin SR2411 (by Dow Corning Toray Co. Ltd.), with the viscosity of 10 mpa·s. It is noted, however, that some deposition of silicone was observed on the nozzle openings and the back side of the nozzle plate. The thickness of the thus selectively formed silicone resin coating was 1.2 μm, and its surface roughness (Ra) was 0.18 μm.

Figure 24A:
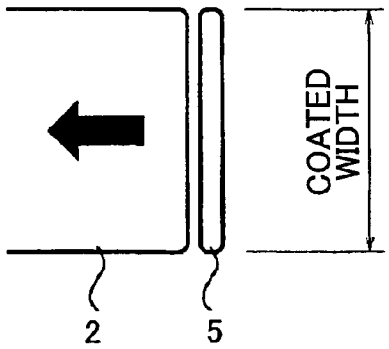
FIG. 24A illustrates the coated width according to an embodiment of the present invention.

The needle 5 has a coater opening at the tip which has a width corresponding to the width with which the nozzle plate 2 is to be coated, as shown in FIG. 24A. Thus, coating of the necessary portion of the nozzle plate 2 can be completed in a single scan by the dispenser 4 in a coating direction.

Figure 24B:
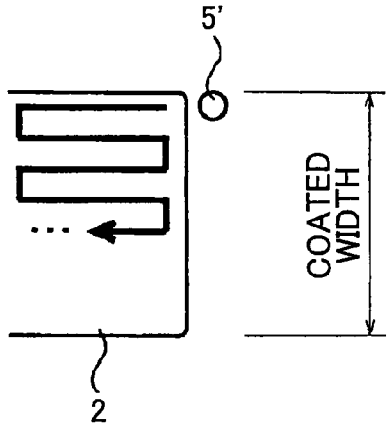
FIG. 24B illustrates the coated width according to the related art.

In other words, the scan for the coating operation needs to be performed in just one direction, and the need for changing the scan direction or scanning in the opposite direction, as shown in FIG. 24B, can be eliminated.

FIG. 24B shows how the nozzle plate 2 is coated using a conventional needle 5'. Because the tip of the needle 5' in this case is much narrower than the width of the nozzle plate 2 to be coated, the scan direction needs to be changed by 90° or reversed in multiple times in order to complete the coating of the entire area, making it difficult to provide a coating with a uniform thickness.

In accordance with the present embodiment, because the coater opening at the tip of the needle 5 has a width corresponding to the width with which the nozzle plate 2 needs to be coated, it becomes possible to provide a uniform thickness over the entire surface that needs to be coated, whereby an accurate surface finish can be achieved.

Figure 25:
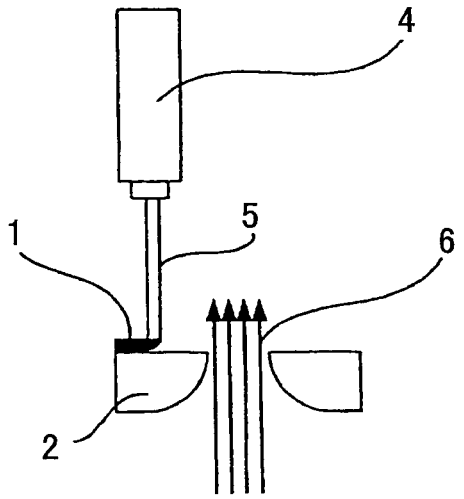
FIG. 25 illustrates another example of how silicone resin is applied using a dispenser.

FIG. 25 illustrates a coating operation performed by using the dispenser 4 in another embodiment. The present embodiment differs from the foregoing embodiment illustrated in FIG. 23 in that silicone is applied while gas 6 is ejected out of a nozzle opening in the nozzle plate 2. The gas 6 may be any gas as long as it does not easily chemically react with the applied silicone. For example, the gas 6 may be air.

By thus performing a coating operation while the gas 6 is ejected via the nozzle opening, a silicone resin coating can be formed on the upper surface of the nozzle plate 2 alone excluding the other nozzle opening surfaces.

Figure 26:
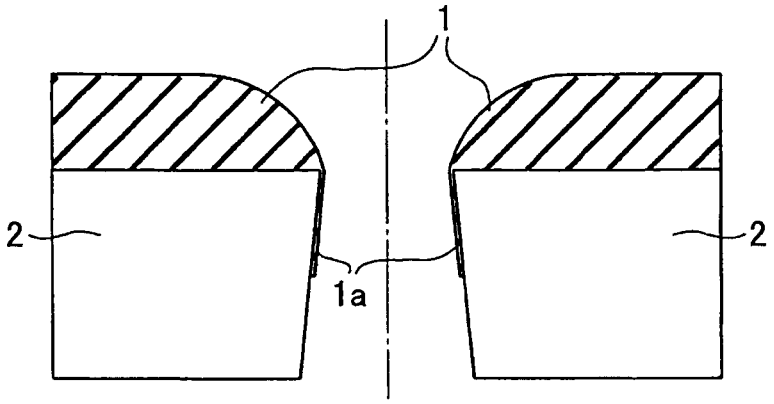
FIG. 26 illustrates the formation of an ink-repellent layer of silicone resin according to another embodiment of the present embodiment.

In another embodiment, similar silicone resin may be applied without the ejection of the gas 6. In this embodiment, as shown in FIG. 26, the gas 6 may be ejected via the nozzle 2 after the silicone resin reached down to a predetermined depth. In this way, it becomes possible to form an ink-repellent layer of silicone resin to a desired depth on the internal surface of the nozzle (such as on the order of several μm).

Thus, in addition to the above-described ink-repellent film 1 on the ink discharge surface, a very thin ink-repellent film la can be formed on the internal surface of the opening from the opening edge of the nozzle plate 2 down to a predetermined depth.

The thus fabricated ink-repellent film 1 formed on the nozzle plate was subjected to wiping with EPDM rubber (rubber hardness: 50). As a result, the ink-repellent film 1 on the nozzle plate retained good ink repellency after 1000 times of wiping. In another test, a nozzle member formed with the ink-repellent film was immersed in ink at temperature of 70° C. for 14 days. As a result, the ink-repellent film retained the same ink repellency as that before the test.

Figure 27:
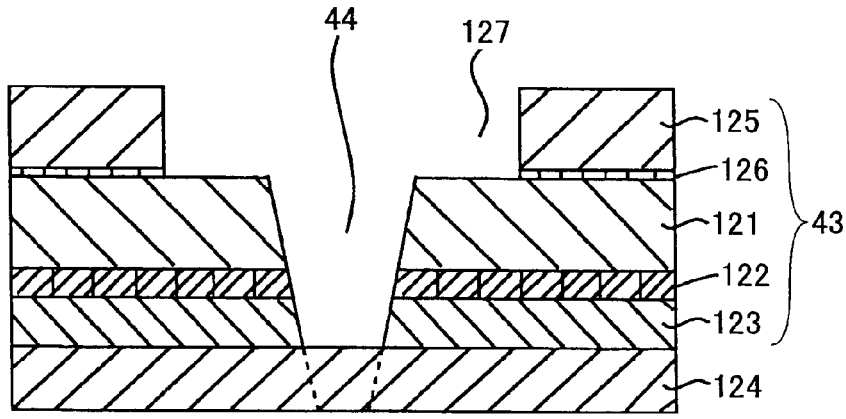
FIG. 27 shows an inkjet head according to an embodiment of the present invention.

Hereafter, the thickness of the water-repellent layer film is discussed. FIG. 27 shows an inkjet head according to an embodiment of the present invention, where a nozzle opening 44 is formed by excimer laser processing. A nozzle plate 43 includes a resin member 121 and a high-stiffness member 125 joined together with thermoplastic cement 126. On the surface of the resin member 121, a $SiO_2$ thin-film layer 122 and a fluorine water-repellent layer 123 are successively laminated. A nozzle opening 44 having a required diameter is formed in the resin member 121. In the high-stiffness member 125, there is formed a nozzle-communicating opening 127 that is in communication with the nozzle opening 44. The $SiO_2$ thin-film layer 122 is formed by a relatively heat-free process, i.e., a process capable of film formation within a temperature range such that the resin member is not thermally affected. Suitable examples are sputtering, ion beam deposition, ion plating, chemical vapor deposition (CVD), and plasma chemical vapor deposition (P-CVD).

It is advantageous to minimize the film thickness of the $SiO_2$ thin-film layer 122 to the extent that its adhesive power can be ensured, from the viewpoint of process time and material cost. If the film thickness is too much, problems may develop during the nozzle opening process by an excimer laser. Specifically, even when the resin member 121 is cleanly processed in the shape of a nozzle opening, part of the $SiO_2$ thin-film layer 122 may not be sufficiently processed and remain unprocessed. More specifically, the film thickness is preferably in the range of from 1 Å to 300 Å and more preferably from 10 Å to 100 Å. In an experiment, sufficient adhesion was obtained even when the $SiO_2$ film thickness was 30 Å and there was no problem in excimer laser processability. When the film thickness was 300 Å, although a small unprocessed portion remained, there was no practical problems. When the thickness was beyond 300 Å, a rather large unprocessed portion remained, resulting in such a nozzle deformity as to render the nozzle unusable.

Figure 28:
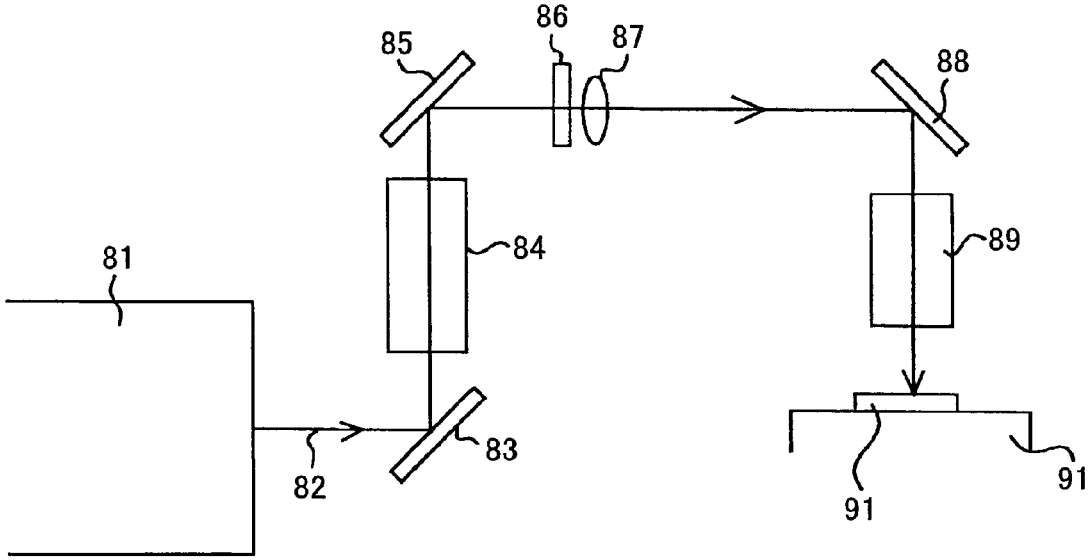
FIG. 28 schematically shows an excimer laser processing apparatus used for forming a nozzle opening.

FIG. 28 shows a configuration of an excimer laser processing apparatus used for forming a nozzle opening. A laser oscillator 81 emits an excimer laser beam 82 which is reflected by mirrors 83, 85, and 88 as it is guided to a processing table 90. Along the optical path of the laser beam 82 before it reaches the processing table 90, there are disposed a beam expander 84, a mask 86, a field lens 87, and imaging optics 89 at respectively predetermined positions so that an optimum beam can reach a processed item 91. The processed item (nozzle plate) 91, which is disposed on the processing table 90, receives the laser beam. The processing table 90, which may consist of a known XYZ table, is configured such that the processed item 91 can be moved as required and irradiated at a desired position with the laser beam. While the laser has been described as being excimer laser, any type of laser may be used as long as it is a short-wavelength UV laser capable of abrasion processing.

Figure 29A:
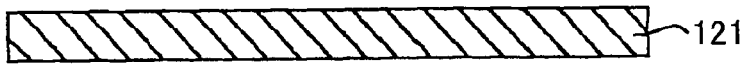
FIG. 29A shows a resin film as a base material for forming a nozzle in a process of manufacturing an inkjet head.

FIG. 29A through 29F schematically show the steps of manufacturing a nozzle plate in a process of manufacturing an inkjet head according to an embodiment of the invention. FIG. 29A shows a resin film 121 as a base material of a nozzle forming member. The resin film 121 may comprise a polyimide film such as Kapton (brand name) by DuPont that contains no particles. A conventional polyimide film contains particles of $SiO_2$ (silica), for example, for the sake of ease of handling (slipperiness) on a roll film handling device. However, the $SiO_2$ (silica) particles obstruct the process of nozzle opening formation by an excimer laser and may lead to a deformation of the nozzle. For this reason, a polyimide film that does not contain $SiO_2$ (silica) particles is preferable.

Figure 29B:
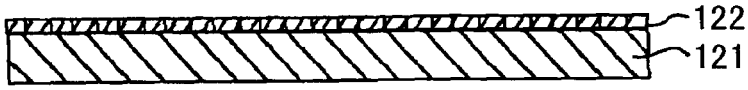
FIG. 29B shows a step of forming an $SiO_2$ thin-film layer on the resin film.

FIG. 29B shows the step of forming the $SiO_2$ thin-film layer on the surface of the resin film 121. The $SiO_2$ thin-film layer 122 is formed preferably by sputtering in a vacuum chamber. The thickness of the $SiO_2$ thin-film layer 122 is preferably in the range of from several A to 200 Å. In this example, the thickness of the $SiO_2$ thin-film layer 122 is between 10 and 50 Å. As regards the sputtering method, it has been learned that by performing Si sputtering and then bombarding the Si surface with $O_2$ ions, the adhesion of the $SiO_2$ thin-film layer 122 to the resin film 121 can be improved and a uniform and dense film can be obtained. In this way, the wiping durability of a water-repellent layer can be improved.

Figure 29C:
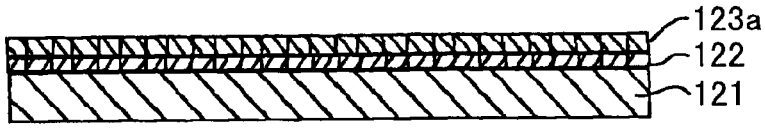
FIG. 29C shows a step of coating the $SiO_2$ thin-film layer with a fluorine water-repellent.

FIG. 29C shows the step of applying a fluorine water-repellent 123*a*. Although application methods such as spin coating, roll coating, screen printing, and spray coating may be used, vacuum deposition is preferable to improve the adhesion of the water-repellent layer. Vacuum deposition is preferably performed in the same vacuum chamber after the formation of the $SiO_2$ thin-film layer 122, as shown in FIG. 30B. This is believed due to the fact that if the work is taken out of the vacuum chamber after the formation of the $SiO_2$ thin-film layer 122, impurities may adhere to the surface of the $SiO_2$ thin-film layer 122 to reduce adhesion. While various fluorine water-repellent materials are known, a fluorine amorphous compound such as perfluoropolyoxetane, modified perfluoropolyoxetane, or a mixture thereof may be preferably used to obtain sufficient water repellency. The aforementioned "OPTOOL DSX" by Daikin Industries, Ltd. may also be referred to as alkoxysilane terminus modified perfluoropolyether.

Figure 29D:
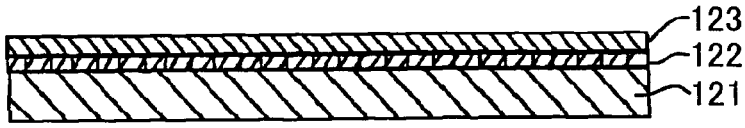
FIG. 29D shows a step of forming a fluorine water-repellent layer.

FIG. 29D shows the step in which the plate is left to stand in the atmosphere, whereby the fluorine water-repellent 123*a* chemically binds to the $SiO_2$ thin-film layer 122 via the moisture in the atmosphere, thereby forming the fluorine water-repellent layer 123.

Figure 29E:
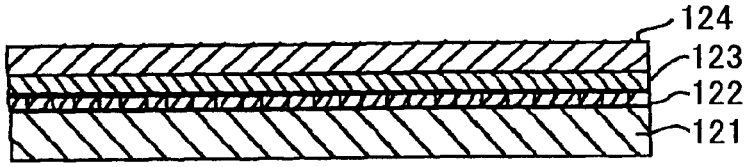
FIG. 29E shows a step of affixing adhesive tape to the fluorine water-repellent layer.

FIG. 29E shows the step of affixing an adhesive tape 124 to the coated surface of the fluorine water-repellent layer 123. The adhesive tape 124 needs to be affixed such that no air bubbles are present between the adhesive tape 124 and the fluorine water-repellent layer 123. If bubbles are present, the quality of a nozzle opening formed in a position where bubbles are present may be degraded by undesired matter during processing.

Figure 29F:
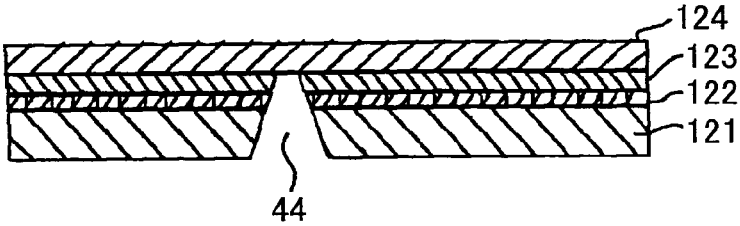
FIG. 29F shows a step of forming a nozzle opening.

FIG. 29F shows the step of processing the nozzle opening 44 by excimer laser irradiation from the polyimide film side. After the nozzle opening 44 is formed, the adhesive tape 124 is removed. In the foregoing, description of the high-stiffness member 125, which is used to increase the rigidity of the nozzle plate 43 as described with reference to FIG. 27, has been omitted. In another embodiment, the high-stiffness member 125 may be appropriately provided between the steps of FIGS. 29D and 29E.

Figure 30:
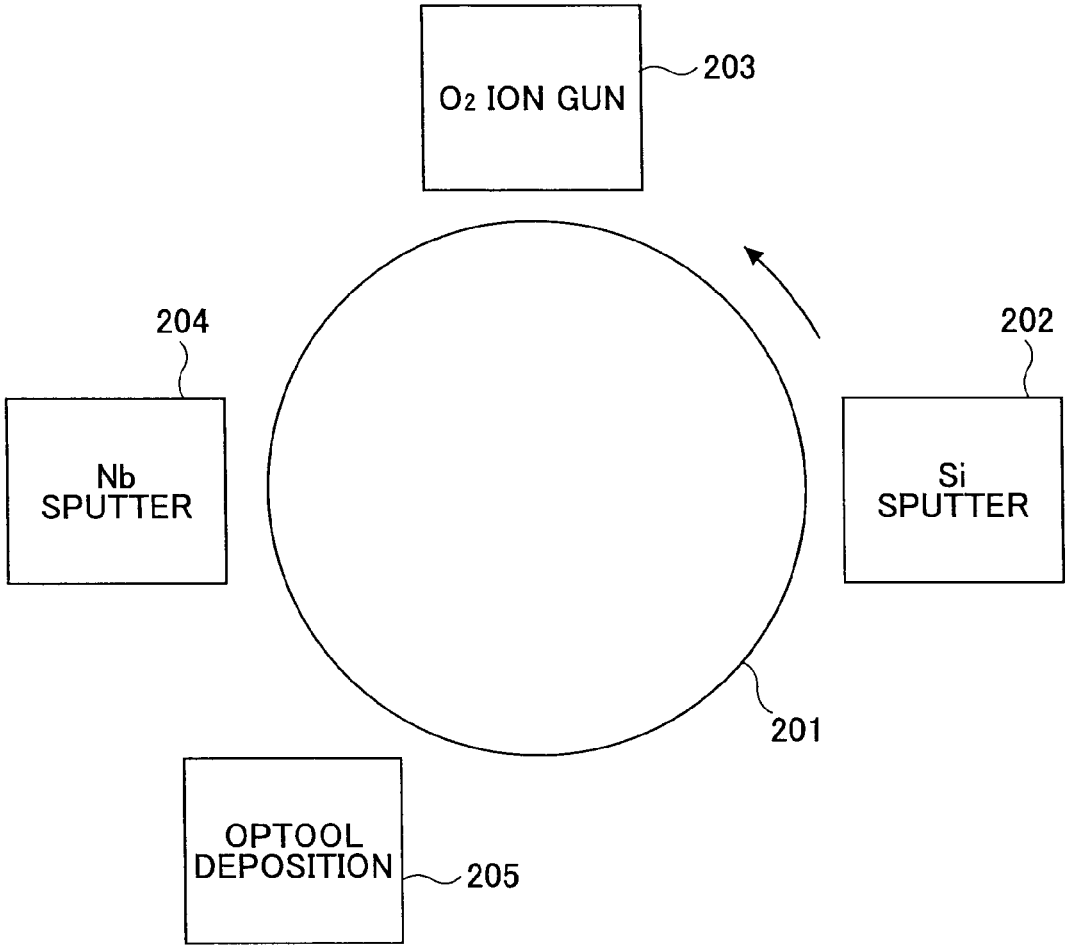
FIG. 30 schematically shows an apparatus for manufacturing an inkjet head according to an embodiment of the present invention.

FIG. 30 schematically shows an apparatus 200 that may be used to manufacture an inkjet head according to an embodiment of the present invention. The apparatus 200 is designed to implement a technique called "MetaMode®" developed by Optical Coating Laboratory, Inc. (OCLI) of the U.S.A. The MetaMode® process may be used to make antireflection/antifouling films on displays. As shown, a drum 201 is surrounded at four locations by an Si sputter station 202, an $O_2$ ion gun station 203, an Nb sputtering station 204, and an OPTOOL vapor deposition station 205, which are all disposed in a chamber that can be vacuumized. First, the Si sputtering station 202 performs Si sputtering. The $O_2$ ion gun station 203 then bombards the Si with $O_2$ ions to form $SiO_2$. Then, Nb is provided by the Nb sputter station 204 and OPTOOL DSX is deposited by the OPTOOL vapor deposition station 205 as needed. In the case of an antireflection film, deposition takes place after a necessary number of layers of Nb and $SiO_2$ with predetermined thicknesses are laminated. Because the function of an antireflection film is not necessary in the case of various embodiments of the present invention, Nb is not required and only one layer each of $SiO_2$ and OPTOOL DSX needs to be formed. By using this apparatus, it becomes possible to deposit OPTOOL DSX in the same vacuum chamber after the formation of the $SiO_2$ thin-film layer 122, as mentioned above.

In the following, the critical surface tension of the ink-repellent layer is described. The critical surface tension of the ink-repellent layer is preferably 5 to 40 mN/m and more preferably 5 to 30 mN/m. When the critical surface tension is greater than 30 mN/m, ink wets the nozzle plate too much over a long period of use, whereby problems such as ink discharge skew and abnormal ink drop formation may occur after repeated printing. When the critical surface tension exceeds 40 mN/m, ink wets the nozzle plate too much from an initial period, and problems such as ink discharge skew and abnormal ink drop formation may occur. In an experiment, ink-repellent materials shown in Table 2 below were applied to an aluminum substrate, which was then heated to prepare nozzle plates having ink-repellent layers. Table 2 shows the result of measuring the critical surface tension of those water-repellent layers.

TABLE 2

| Manufacturer | Product name | Critical surface tension (mN/m) | Discharge stability |
|---|---|---|---|
| Dow Corning Toray | SR2411 | 21.6 | Good |
| Shin-Etsu Chemical | KBM7803 | 16.9 | Good |
| Shin-Etsu Chemical | KP801M | 6.6 | Good |

The critical surface tension can be determined by the Zisman method. Specifically, droplets of liquids with known surface tensions are placed onto the ink-repellent layer, and their contact angles θ are measured. By plotting the surface tension of each liquid on the x axis and cos θ on the y axis, a line sloping to the right (Zisman Plot) is obtained.

The critical surface tension γc is the surface tension at which Y=1 (θ=0). The critical surface tension can be also obtained by other methods, such as the Fowkes method, the Owens and Wendt method, and the Van Oss method. In an experiment, inkjet heads were fabricated using nozzle plates having an ink-repellent layer by the same method as described above. The cyan ink according to Manufactured Example 1 (which is described later) was ejected from the inkjet head. When the trajectory of the ink was recorded in video and observed, normal particles of the ink were formed in all of the cases of the nozzle plates, indicating the good discharge stability of the inkjet heads.

Hereafter, an example of a specific ink according to an embodiment is described.

Ink

The ink according to the present embodiment contains at least water, a colorant, and a humectant. It may also contain a penetrant, a surfactant, and other components as needed.

The surface tension of the ink is preferably 15 to 40 mN/m and more preferably 20 to 35 mN/m. When the surface tension is less than 15 mN/m, the ink may wet the nozzle plate so much that ink droplets are not properly formed, or significant bleeding may occur on the recording medium, thus preventing the stable discharge of the ink. When the surface tension is greater than 40 mN/m, the ink may fail to penetrate the recording medium sufficiently, resulting in beading or an extended drying time.

The surface tension of the ink may be measured with the CBVP-Z surface tensiometer from Kyowa Interface Science Co., Ltd., using a platinum plate at temperature of 25° C.

Colorant

Preferably, at least one of a pigment, a dye, and colored particle is used as the aforementioned colorant.

Preferably, the aforementioned colored particle comprises an aqueous dispersion of polymer particles containing at least a pigment or a dye as a colorant.

That the polymer particles "contain" a colorant means that the colorant is either encapsulated in the polymer particles, the colorant is adsorbed on the surface of the polymer particles, or both. Not all of the colorant needs to be encapsulated in or adsorbed on the polymer particles; the colorant may be dispersed in an emulsion as long as the advantageous effects of various embodiments of the present invention are not adversely affected. The colorant is not particularly limited and may be suitably selected depending on the purpose, as long as it is water-insoluble or poorly water-soluble and can be adsorbed on the polymer particles.

"Water-insoluble" or "poorly water-soluble" indicates that no more than 10 parts by mass of the colorant can be dissolved in 100 parts by mass of water at a temperature of 20° C. "Dissolved" means that no separation or sediment of the colorant is identified in the upper or the lower layer of the aqueous solution by visual inspection.

Preferably, the volume average particle size of a polymer particle (colored particle) containing the colorant is 0.01 to 0.16 μm in the ink. When the volume average particle size is less than 0.01 μm, the polymer particles tend to flow, resulting in increased bleeding or decrease in light resistance. When the volume average particle size is more than 0.16 μm, the nozzle may be clogged or color development of the ink may be inhibited.

Examples of the colorant include a water-soluble dye, an oil-soluble dye, a disperse dye, and a pigment. From the viewpoint of absorbability and encapsulation, an oil-soluble dye or a disperse dye is preferable. From the viewpoint of light resistance of an image formed, a pigment is preferable.

Preferably, the amount of the dye that is dissolved in an organic solvent, such as a ketone solvent, is 2 g/l or more and more preferably 20 to 600 g/l from the viewpoint of efficient impregnation in the polymer particles.

The aforementioned water-soluble dye may comprise a dye classified as being an acid dye, a direct dye, a basic dye, a reactive dye, or a food dye in the Color Index. Preferably, a dye with high water-resistance and high light resistance is used.

Humectant

The humectant is not particularly limited and may be appropriately selected depending on the purpose. A suitable example is at least one selected from a polyol compound, a lactam compound, a urea compound, and a saccharide.

Penetrant

The aforementioned penetrant may comprise a water-soluble organic solvent such as a polyol compound or a glycol ether compound. Preferably, a polyol compound or a glycol ether compound having a carbon number of eight or larger may be suitably used.

If the carbon number of the polyol compound is less than eight, sufficient permeability may not be obtained, resulting in staining the recording medium during both-side printing. This may also result in decrease in character quality or image density due to the insufficient spread of ink over the recording medium and poorer filling of the pixels.

Preferable examples of the polyol compound having the carbon number of eight or greater include 2-ethyl 1,3-hexanediol (solubility: 4.2% (25° C.)), and 2,2,4-trimethyl 1,3-pentanediol (solubility: 2.0% (25° C.)).

The added amount of the penetrant is not particularly limited but may be appropriately selected depending on the purpose. Preferably, the added amount of the penetrant is 0.1 to 20% by mass and more preferably 0.5 to 10% by mass.

Surfactant

The surfactant is not particularly limited and may be appropriately selected depending on the purpose. Examples are an anion surfactant, a nonionic surfactant, an amphoteric surfactant, and a fluorine surfactant.

A preferable example of the fluorinated surfactant is represented by the following general formula:

$$CF_3CF_2(CF_2CF_2)_m—CH_2CH_2O(CH_2CH_2O)_nH \quad (A)$$

where m is an integer of from 0 to 10, and n is an integer of from 1 to 40.

Examples of the fluorinated surfactant include a perfluoroalkyl sulfonic acid compound, a perfluoroalkyl carvone compound, a perfluoroalkyl phosphoric ester compound, a perfluoroalkyl ethylene oxide adduct, and a polyoxyalkylene ether polymer compound having a perfluoroalkylether group as a side chain. Among those, a polyoxyalkylene ether polymer compound having a perfluoroalkylether group as a side chain is particularly preferable from the safety standpoint because it has a low foaming property and a low fluorine compound bioaccumulation potential, which is seen as a problem in recent years.

Examples of the perfluoroalkyl sulfonic acid compounds include perfluoroalkyl sulfonic acid and perfluoroalkyl sulfonate.

Examples of the perfluoroalkyl carvone compounds include perfluoroalkyl carboxylic acid and perfluoroalkyl carboxylate.

Examples of the perfluoroalkyl phosphoric ester compounds include perfluoroalkyl phosphoric ester and a salt of perfluoroalkyl phosphoric ester.

Examples of the polyoxyalkylene ether polymer compounds having a perfluoroalkylether group as a side chain include a polyoxyalkylene ether polymer having a perfluoroalkylether group as a side chain, a sulfate ester salt of a polyoxyalkylene ether polymer having a perfluoroalkylether group as a side chain, and a salt of a polyoxyalkylene ether polymer having a perfluoroalkylether group as a side chain.

Counter ions of salts in the above fluorinated surfactants include Li, Na, K, $NH_4$, $NH_3CH_2CH_2OH$, $NH_2(CH_2CH_2OH)_2$, and $NH(CH_2CH_2OH)_3$.

The fluorinated surfactant may be appropriately synthesized, or a commercially available product may be used.

Examples of the commercially available fluorinated surfactant include Surflon S-111, S-112, S-113, S-121, S-131, S-132, S-141, S-145 (Asahi Glass Co., Ltd.); Fluorad FC-93, FC-95, FC-98, FC-129, FC-135, FC-170C, FC-430, FC-431 (Sumitomo 3M Limited); Megafac F-470, F1405, F-474 (Dainippon Ink and Chemicals, Incorporated); Zonyl TBS, FSP, FSA, FSN-100, FSN, FSO-100, FSO, FS-300, UR (DuPont); FT-110, FT-250, FT-251, FT-400S, FT-150, FT-400SW (NEOS Co. Ltd.); and PF-151N (Omnova Solutions, Inc.). Among the above, Zonyl FS-300, FSN, FSN-100, and FSO (DuPont) are particularly preferable from the viewpoint of reliability and color development.

Other Components

The aforementioned other components are not particularly limited and may be appropriately selected as needed. Examples are a resin emulsion, a pH adjuster, an antiseptic or a fungicide, a rust inhibitor, an antioxidant, an ultraviolet absorber, an oxygen absorber, and a light stabilizer.

Resin Emulsion

The resin emulsion is a dispersion of resin particles in water as a continuous phase. It may contain a dispersing agent such as a surfactant as needed.

Generally, the content of resin particles as a disperse phase component (i.e., the content of the resin particles in the resin emulsion) is preferably 10 to 70% by mass. The average particle size of the resin particles is preferably 10 to 1000 nm and more preferably 20 to 300 nm from the viewpoint of use in an inkjet recording apparatus.

The added amount of resin particles in the resin emulsion with respect to the ink is preferably 0.1 to 50% by mass, more preferably 0.5 to 20% by mass, and further more preferably 1 to 10% by mass. When the added amount is less than 0.1% by mass, sufficient improvements in clogging resistance or discharge stability may not be obtained. When the added amount is more than 50% by mass, the preservation stability of the ink may be reduced.

The viscosity of the ink is preferably 1 to 30 cPs and more preferably 2 to 20 cPs at temperature of 20° C. When the viscosity is higher than 20 cPs, sufficient discharge stability may not be obtained.

The pH of the ink is preferably 7 to 10.

The color of the ink is not particularly limited and may be appropriately selected depending on the purpose. Examples are yellow, magenta, cyan, and black. A multi-color image can be formed by using an ink set of two or more of such colors. A full-color image can be formed by using a set of inks of all of the colors.

In the following, exemplary ink preparations are described. However, the present invention is not limited to any of those examples.

PREPARATION EXAMPLE 1

—Preparation of Dispersion of Polymer Particles Containing Copper Phthalocyanine Pigment—

The atmosphere of a 1L flask equipped with a mechanical stirrer, a thermometer, a nitrogen gas inlet tube, a reflux tube, and a dropping funnel was substituted sufficiently with nitrogen gas. The 1L flask was then charged with 11.2 g of styrene, 2.8 g of acrylic acid, 12.0 g of lauryl methacrylate, 4.0 g of polyethylene glycol methacrylate, 4.0 g of styrene macromer (Toagosei Co., Ltd., brand name: AS-6), and 0.4 g of mercaptoethanol, and the temperature was raised to 65° C. Then, a mixture solution of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (Toagosei Co., Ltd., brand name: AS-6), 3.6 g of mercaptoethanol, 2.4 g of azobisdimethylvaleronitrile, and 18 g of methyl ethyl ketone was added dropwise into the flask over a period of 2.5 hours.

After the dripping was completed, a mixture solution of 0.8 g of azobisdimethylvaleronitrile and 18 g of methyl ethyl ketone was added dropwise into the flask over a period of 0.5 hours. After the resulting solution was matured for 1 hour at the temperature of 65° C., 0.8 g of azobisdimethylvaleronitrile was added, and the solution was further matured over a period of 1 hour. After the reaction was over, 364 g of methyl ethyl ketone was put into the flask, obtaining 800 g of a polymer solution with a concentration of 50% by mass. A portion of the obtained polymer solution was dried and then measured by gel permeation chromatography (standard: polystyrene, solvent: tetrahydrofuran). The weight-average molecular weight (Mw) was 15,000.

Next, 28 g of the obtained polymer solution, 26 g of copper phthalocyanine pigment, 13.6 g of 1 mol/L potassium hydroxide solution, 20 g of methyl ethyl ketone, and 30 g of ion-exchanged water were mixed and stirred sufficiently. The resulting substance was kneaded 20 times using a tripole roll mill (NR-84A from Noritake Co., Limited). The obtained paste was put in 200 g of ion-exchanged water. After sufficiently stirring, methyl ethyl ketone and water were distilled away with an evaporator. As a result, 160 g of a blue polymer particle dispersion having a solid content of 20.0% by mass was obtained.

The average particle size (D50%) of the resultant polymer particles as measured with a particle size distribution analyzer (Microtrac UPA, Nikkiso Co., Ltd.) was 93 nm.

PREPARATION EXAMPLE 2

—Preparation of Dispersion of Polymer Particles Containing Dimethyl Quinacridone Pigment—

A purple-red polymer particle dispersion was prepared in the same manner as in Preparation Example 1 with the exception that the copper phthalocyanine pigment was replaced with C. I. Pigment Red 122.

The average particle size (D50%) of the obtained polymer particles as measured with a particle size distribution analyzer (Microtrac UPA, Nikkiso Co., Ltd.) was 127 nm.

PREPARATION EXAMPLE 3

—Preparation of Dispersion of Polymer Particles Containing Monoazo Yellow Pigment—

A yellow polymer particle dispersion was prepared in the same manner as in Preparation Example 1 with the exception that the copper phthalocyanine pigment was replaced with C. I. Pigment Yellow 74.

The average particle size (D50%) of the resultant polymer particles as measured with a particle size distribution analyzer (Microtrac UPA, Nikkiso Co., Ltd.) was 76 nm.

PREPARATION EXAMPLE 4

—Preparation of Dispersion of Carbon Black Processed with Sulfonating Agent—

150 g of a commercially available carbon black pigment (Printex #85, Degussa) was well mixed in 400 ml of sulfolane. After micro-dispersing with a beads mill, 15 g of amidosulfuric acid was added to the solution, which was then stirred for 10 hours at 140-150° C. The resultant slurry was put in 1000 ml of ion-exchanged water, and the solution was centrifuged at 12,000 rpm. As a result, a surface-treated carbon black wet cake was obtained. The obtained carbon black wet cake was dispersed again in 2,000 ml of ion-exchanged water. After adjusting the pH with lithium hydroxide, the solution was desalted/condensed using a ultrafilter, obtaining a carbon black dispersion with a pigment concentration of 10% by mass, which was then filtered with a nylon filter with an average pore diameter of 1 μm.

The average particle size (D50%) of the particles in the carbon black dispersion as measured with a particle size distribution analyzer (Microtrac UPA, Nikkiso Co., Ltd.) was 80 nm.

MANUFACTURE EXAMPLE 1

—Preparation of Cyan Ink—

20.0% by mass of the dispersion of polymer particles containing a copper phthalocyanine pigment according to Preparation Example 1, 23.0% by mass of 3-methyl-1,3-butanediol, 8.0% by mass of glycerin, 2.0% by mass of 2-ethyl-1,3-hexanediol, 2.5% by mass of FS-300 (DuPont) as a fluorinated surfactant, 0.2% by mass of Proxel LV (Avecia KK) as an antiseptic or a fungicide, 0.5% by mass of 2-amino-2-ethyl-1,3-propanediol, and an appropriate amount of ion-exchanged water were mixed to a total of 100% by mass. The mixture was then filtered using a membrane filter with an average pore diameter of 0.8 μm.

MANUFACTURE EXAMPLE 2

—Preparation of Magenta Ink—

20.0% by mass of the dispersion of polymer particles containing a dimethyl quinacridone pigment according to Preparation Example 2, 22.5% by mass of 3-methyl-1,3-butanediol, 9.0% by mass of glycerin, 2.0% by mass of 2-ethyl-1,3-hexanediol, 2.5% by mass of FS-300 (DuPont) used as a fluorinated surfactant, 0.2% by mass of Proxel LV (Avecia KK) used as an antiseptic or a fungicide, 0.5% by mass of 1-amino-2,3-propanediol, and an appropriate amount of ion-exchanged water were mixed to a total of 100% by mass. The mixture was then filtered using a membrane filter with an average pore diameter of 0.8 μm.

MANUFACTURE EXAMPLE 3

—Preparation of Yellow Ink—

20.0% by mass of the dispersion of polymer particles containing a monoazo yellow pigment according to Preparation Example 3, 24.5% by mass of 3-methyl-1,3-butanediol, 8.0% by mass of glycerin, 2.0% by mass of 2-ethyl-1,3-hexanediol, 2.5% by mass of FS-300 (DuPont) as a fluorinated surfactant, 0.2% by mass of Proxel LV (Avecia KK) as an antiseptic or a fungicide, 0.5% by mass of 2-amino-2-methyl-1,3-propanediol, and an appropriate amount of ion-exchanged water were mixed to a total of 100% by mass. The mixture was then filtered with a membrane filter with an average pore diameter of 0.8 μm.

MANUFACTURE EXAMPLE 4

—Preparation of Black Ink—

20.0% by mass of the carbon black dispersion according to Preparation Example 4, 22.5% by mass of 3-methyl-1,3-butanediol, 7.5% by mass of glycerin, 2.0% by mass of 2-pyrrolidone, 2.0% by mass of 2-ethyl-1,3-hexanediol, 2.5% by mass of FS-300 (DuPont) as a fluorinated surfactant, 0.2% by mass of Proxel LV (Avecia KK) as an antiseptic or a fungicide, 0.2% by mass of choline, and an appropriate amount of ion-exchanged water were mixed to a total of 100% by mass. The mixture was then filtered with a membrane filter with an average pore diameter of 0.8 μm.

The surface tension and viscosity of the inks according to Manufacture Examples 1 through 4 were measured as described below. The results are shown in Table 3.

TABLE 3

| | Viscosity(mPa · s) | Surface tension(mN/m) |
|---|---|---|
| Manufacture Ex. 1 | 8.05 | 25.4 |
| Manufacture Ex. 2 | 8.09 | 25.4 |
| Manufacture Ex. 3 | 8.11 | 25.7 |
| Manufacture Ex. 4 | 8.24 | 25.4 |

Measurement of Viscosity

The viscosity was measured at 25° C., using the R-500 Viscometer from Toki Sangyo Co., Ltd. under the conditions of cone 1° 34',×R24, 60 rpm, and 3 minutes later).

Measurement of Surface Tension

The surface tension was measured at 25° C., using a surface tensiometer (CBVP-Z from Kyowa Interface Science Co., Ltd.) and a platinum plate.

Fabrication of Support Member

A support member with a basis weight of 79 g/m$^2$ was fabricated by making paper with a fourdrinier from a 0.3% by mass slurry with the following composition. In the size press step of the papermaking process, an oxidized starch solution was applied to the support member such that the attached amount of solid content on the support member was 1.0 g/m$^2$ per side.

| | |
|---|---|
| Leaf bleached kraft pulp (LBKP) | 80 parts by mass |
| Needle bleached kraft pulp (NBKP) | 20 parts by mass |
| Precipitated calcium carbonate (brand name: TP-121, Okutama Kogyo Co., Ltd.) | 10 parts by mass |
| Aluminum sulfate | 1.0 part by mass |
| Amphoteric starch (brand name: Cato3210, Nippon NSC Ltd. ) | 1.0 part by mass |
| Neutral rosin size agent (brand name: NeuSize M-10, Harima Chemicals, Inc.) | 0.3 part by mass |
| Yield improving agent (brand name: NR-11LS, HYMO Co., Ltd. ) | 0.02 part by mass |

MANUFACTURE EXAMPLE 5

—Fabrication of Recording Medium 1—

70 parts by mass of clay as a pigment in which the proportion of particles with the diameter of 2 μm or smaller was 97% by mass, 30 parts by mass of heavy calcium carbonate with an average particle size of 1.1 μm, 8 parts by mass of styrene-butadiene copolymer emulsion as an adhesive having a glass-transition temperature (Tg) of −5° C., 1 part by mass of phosphoric esterified starch, and 0.5 part by mass of calcium stearate as an aid were mixed. Water was further added, thereby preparing a coating liquid with a solid content concentration of 60% by mass.

The obtained coating liquid was applied to both sides of the above support member using a blade coater so that the attached solid amount per side of the support member was 8 g/m$^2$. After hot-air drying, supercalender process was performed, thereby obtaining a Recording Medium 1.

MANUFACTURE EXAMPLE 6

—Fabrication of Recording Medium 2—

70 parts by mass of clay as a pigment in which the proportion of particles with the diameter of 2 μm or smaller was 97% by mass, 30 parts by mass of heavy calcium carbonate with an average particle size of 1.1 μm, 7 parts by mass of styrene-butadiene copolymer emulsion as an adhesive having a glass-transition temperature (Tg) of −5° C., 0.7 part by mass of phosphoric esterified starch, and 0.5 part by mass of calcium stearate as an aid were mixed. Water was further added, thereby preparing a coating liquid with a solid content concentration of 60% by mass.

The obtained coating liquid was applied to both sides of the above support member using a blade coater so that the attached solid amount was 8 g/m$^2$ per side. After hot-air drying, supercalender process was performed, thereby obtaining a Recording Medium 2

EXAMPLE 1

—Ink Set, Recording Medium, and Image Recording—

An Ink Set 1 of the black ink according to Manufacture Example 4, the yellow ink according to Manufacture Example 3, the magenta ink according to Manufacture Example 2, and the cyan ink according to Manufacture Example 1 was prepared a conventional method.

Using Ink Set 1 and Recording Medium 1, printing was performed using a 300 dpi prototype drop-on-demand printer having nozzles with resolution of 300 dpi, at an image resolution of 600 dpi and the maximum ink droplet of 18 pl. The total amount of the secondary color was limited to 140% to control the attached amount of ink. A solid image and characters were printed, obtaining an image print.

EXAMPLE 2

—Ink Set, Recording Medium, and Image Recording—

Printing was performed in the same manner as in Example 1 with the exception that Recording Medium 2 was used as a recording medium, obtaining an image print.

EXAMPLE 3

—Ink Set, Recording Medium, and Image Recording—

Printing was performed in the same manner as in Example 1 with the exception that a coated paper for gravure printing (brand name: Space DX, basis weight=56 g/m$^2$, Nippon Paper Industries Co., Ltd.; hereafter referred to as a Recording Medium 3) was used as a recording medium, obtaining an image print.

COMPARATIVE EXAMPLE 1

—Ink Set, Recording Medium, and Image Recording—

Printing was performed in substantially the same manner as in Example 1 with the exception that a commercially available coated paper for offset printing (brand name: Aurora Coat, basis weight—104.7 g/m$^2$, Nippon Paper Industries Co., Ltd.; to be hereafter referred to as a Recording Medium 4) was used as a recording medium, obtaining an image print.

COMPARATIVE EXAMPLE 2

—Ink Set, Recording Medium, and Image Recording—

Printing was performed in the same manner as in Example 1 with the exception that a commercially available matt coated paper for inkjet printing (brand name: Superfine, Seiko Epson Corporation; to be hereafter referred to as a Recording Medium 5) was used as a recording medium, thereby obtaining an image print.

Measurement of Transferred Amounts of Pure Water and Cyan Ink with Dynamic Scanning Absorptometer For each of the above Recording Media 1-5, the transfer amount for pure water and cyan ink were measured using a dynamic scanning absorptometer (K350 series, Type D, Kyowa Co., Ltd.). The transfer amounts for the contact times of 100 ms and 400 ms were obtained by interpolation of measured values of the transfer amounts in adjacent contact times. The results are shown in Table 4.

TABLE 4

| | | Pure water (ml/m$^2$) Contact time (ms) | | Ink of Manufacture Ex. 1 (ml/m$^2$) (γ = 25) Contact time (ms) | |
|---|---|---|---|---|---|
| | Medium | 100 | 400 | 100 | 400 |
| Ex. 1 | 1 | 10.1 | 20.2 | 7.2 | 14.8 |
| Ex. 2 | 2 | 25.2 | 28.5 | 14.6 | 19.4 |
| Ex. 3 | 3 | 10.4 | 21.8 | 6.4 | 8.8 |
| Comp. Ex. 1 | 4 | 2.8 | 3.4 | 2.7 | 3.1 |
| Comp. Ex. 2 | 5 | 41.0 | 44.8 | 38.1 | 46.2 |

The image print of each of Examples 1 through 3 was evaluated in terms of beading, bleeding, spur mark, and glossiness as described below. The results are shown in table 5.

TABLE 5

| | Beading | Bleeding | Spur mark | Glossiness |
|---|---|---|---|---|
| Ex. 1 | Good | Good | Good | 29.4 |
| Ex. 2 | Excellent | Excellent | Excellent | 27.8 |
| Ex. 3 | Good | Good | Good | 22.3 |
| Comp. Ex. 1 | Bad | Poor | Bad | 32.1 |
| Comp. Ex. 2 | Excellent | Excellent | Excellent | 1.7 |

Beading

The degree of beading in a solid green image portion of each image print was visually observed and evaluated according to the following criteria.

Excellent: No beading is observed and image is uniformly printed.

Good: Beading is slightly observed.

Poor: Beading is clearly observed.

Bad: Excessive beading is observed.

Bleeding

The degree of bleeding of a black character in the yellow background in each image print was visually observed and evaluated according to the following evaluation criteria.

Excellent: No bleeding is observed and print is clear.

Good: Bleeding is slightly observed.

Poor: Bleeding is clearly observed.

Bad: Outline of the character is obscured by bleeding.

Spur Mark

The degree of spur marks in each printed image was visually observed and evaluated according to the following criteria.

Excellent: No spur mark is observed.
Good: Spur mark is slightly observed.
Poor: Spur mark is clearly observed.
Bad: Excessive spur mark is observed.
Evaluation of Glossiness The 60° specular gloss (JIS Z8741) of a solid cyan image portion of each image print was measured.

The results shown in Table 5 indicate that Examples 1 through 3, each of which contains at least water, a colorant, and a humectant, and each of which is based on a combination of an ink having the surface tension of 20 to 35 mN/m at 25° C. with a recording medium having the ink transfer amount as measured with a dynamic scanning absorptometer of 4 to 15 $ml/m^2$ at the contact time of 100 ms and 7 to 20 $ml/M^2$ at the contact time of 400 ms, are superior to Comparative Examples 1 and 2 in all of the respects of beading, bleeding, spur mark, and glossiness.

Although the invention has been described in detail with reference to certain embodiments, variations and modifications exist within the scope and spirit of the invention as described and defined in the following claims.

The present application is based on the Japanese Priority Application No. 2007-182626 filed Jul. 11, 2007, the entire contents of which are hereby incorporated by reference.

The invention claimed is:

1. An image forming apparatus comprising:

a carriage configured to move in a scan direction;

a recording head mounted on the carriage, the recording head including plural nozzles and configured to record a recording medium by discharging ink via the nozzles onto the recording medium;

a detection unit configured to detect whether one or more expendable supplies required for image formation are specific expendable supplies;

a notifying unit configured to notify an operator upon detection of a non-specific expendable supply; and an image forming method changing unit configured to automatically change an image forming method that is currently set, wherein the changing of the image forming method is performed by modifying a part of a standard image forming method, wherein the changing of the image forming method involves increasing the number of scan passes made by the recording head for image formation, wherein a standby time between successive vertical scan operations is extended to be longer than that of the image forming method that is currently set, and wherein the changing of the image forming method involves extending a standby time that is provided in an interval between a switching of recording surfaces, when printing both top and bottom surfaces of the recording medium successively and when detecting that an expendable supply of the one or more expendable supplies required for image formation is a non-specific expendable supply.

2. The image forming apparatus according to claim 1, wherein the changing of the image forming method involves reducing the speed of movement of the carriage.

3. The image forming apparatus according to claim 1, wherein the changing of the image forming method is carried out near a border of the recording medium when a borderless printing is performed on the recording medium.

4. The image forming apparatus according to claim 1, wherein the changing of the image forming method involves reducing the number of droplet sizes for gradation expression.

5. The image forming apparatus according to claim 1, wherein the changing of the image forming method involves changing a bidirectional printing to a one-directional printing.

6. The image forming apparatus according to claim 1, wherein the changing of the image forming method involves reducing the number of lines in halftone processing.

7. The image forming apparatus according to claim 1, wherein the changing of the image forming method involves reducing the amount of ink that attaches to the recording medium per unit area.

8. The image forming apparatus according to claim 1, wherein the changing of the image forming method involves eliminating a use of a color ink when generating colors of black and gray.

9. The image forming apparatus according to claim 1, wherein the changing of the image forming method involves reducing an amount of a color ink used for generating colors of black and gray.

10. The image forming apparatus according claim 1, wherein the changing of the image forming method involves extending a standby time for each of plural pages that are recorded successively.

* * * * *